US009029056B2

(12) United States Patent
Kenmoku et al.

(10) Patent No.: US 9,029,056 B2
(45) Date of Patent: May 12, 2015

(54) TONER

(75) Inventors: Takashi Kenmoku, Mishima (JP); Hitoshi Itabashi, Yokohama (JP); Akane Masumoto, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 17 days.

(21) Appl. No.: 14/116,997

(22) PCT Filed: May 17, 2012

(86) PCT No.: PCT/JP2012/063242
§ 371 (c)(1),
(2), (4) Date: Nov. 11, 2013

(87) PCT Pub. No.: WO2012/157782
PCT Pub. Date: Nov. 22, 2012

(65) Prior Publication Data

US 2014/0106272 A1 Apr. 17, 2014

(30) Foreign Application Priority Data

May 18, 2011 (JP) ..... 2011-111617

(51) Int. Cl.
*G03G 9/097* (2006.01)
*G03G 9/087* (2006.01)
(Continued)

(52) U.S. Cl.
CPC ..... *G03G 9/09775* (2013.01); *G03G 9/08791* (2013.01); *G03G 9/0806* (2013.01); *G03G 9/0815* (2013.01); *G03G 9/08706* (2013.01); *G03G 9/08708* (2013.01);
(Continued)

(58) Field of Classification Search
CPC ..... G03G 9/08708; G03G 9/08726; G03G 9/08788; G03G 9/08791; G03G 9/09733; G03G 9/09741
See application file for complete search history.

(56) References Cited

U.S. PATENT DOCUMENTS

| | | | |
|---|---|---|---|
| 4,797,339 | A | 1/1989 | Maruyama et al. |
| 4,996,127 | A | 2/1991 | Hasegawa et al. |
| 5,766,814 | A | 6/1998 | Baba et al. |

(Continued)

FOREIGN PATENT DOCUMENTS

| | | | |
|---|---|---|---|
| JP | 36-10231 | B | 7/1961 |
| JP | 59-53856 | A | 3/1984 |

(Continued)

OTHER PUBLICATIONS

International Search Report and Written Opinion of the International Searching Authority, International Application No. PCT/JP2012/063242, Mailing Date Jul. 31, 2012.

(Continued)

*Primary Examiner* — Peter Vajda
(74) *Attorney, Agent, or Firm* — Fitzpatrick, Cella, Harper and Scinto

(57) ABSTRACT

Provided is a toner having high charging rapidity to reach a sufficient charging amount in a short time, high stability of charging from the initial stage to a time when a large amount of sheets is printed out, and high stability of charging under a high temperature and high humidity. In a toner including toner particles, each of which contains at least a binder resin, a colorant, and a charge controlling resin, the charge controlling resin is a copolymer of a structure A having at least a specific salicylic acid derivative structure and a structure B having sulfonic acid or sulfonic acid ester as a substituent.

4 Claims, 1 Drawing Sheet

(51) Int. Cl.
*G03G 9/08* (2006.01)
*G03G 9/093* (2006.01)

(52) U.S. Cl.
CPC ..... *G03G 9/08722* (2013.01); *G03G 9/08726* (2013.01); *G03G 9/08733* (2013.01); *G03G 9/09321* (2013.01)

(56) References Cited

U.S. PATENT DOCUMENTS

| | | | | |
|---|---|---|---|---|
| 5,874,194 | A * | 2/1999 | Wilson et al. | 430/108.22 |
| 5,985,502 | A | 11/1999 | Ayaki et al. | |
| 6,106,990 | A | 8/2000 | Tazawa et al. | |
| 6,124,070 | A | 9/2000 | Baba et al. | |
| 6,358,658 | B1 | 3/2002 | Tazawa et al. | |
| 6,566,028 | B2 | 5/2003 | Tazawa et al. | |
| 6,808,855 | B2 | 10/2004 | Ayaki et al. | |
| 7,252,917 | B2 | 8/2007 | Ohno et al. | |
| 7,323,282 | B2 | 1/2008 | Ohno et al. | |
| 7,682,765 | B2 | 3/2010 | Sugawa et al. | |
| 7,718,338 | B2 | 5/2010 | Fujimoto et al. | |
| 8,574,801 | B2 | 11/2013 | Itabashi et al. | |
| 8,609,312 | B2 | 12/2013 | Itabashi et al. | |
| 2011/0159425 | A1 | 6/2011 | Itabashi et al. | |
| 2014/0072908 | A1 | 3/2014 | Masumoto et al. | |
| 2014/0087299 | A1 | 3/2014 | Kenmoku et al. | |

FOREIGN PATENT DOCUMENTS

| | | | |
|---|---|---|---|
| JP | 59-61842 | A | 4/1984 |
| JP | 62-106473 | A | 5/1987 |
| JP | 62-187429 | A | 8/1987 |
| JP | 63-186253 | A | 8/1988 |
| JP | 63-270060 | A | 11/1988 |
| JP | 4-16858 | A | 1/1992 |
| JP | 8-30017 | A | 2/1996 |
| JP | 2694572 | B2 | 12/1997 |
| JP | 2807795 | B2 | 10/1998 |
| JP | 2006-309195 | A | 11/2006 |
| JP | 2008-304723 | A | 12/2008 |
| JP | 2010-185907 | A | 8/2010 |

OTHER PUBLICATIONS

Tirrell, et al., "Functional Polymers. VI. Preparation and Polymerization of Methyl 3-Vinylsalicylate, Methyl 3-Vinylacetylsalicylate, 3-Vinylsalicylic Acid, and 3-Vinylacetylsalicylic Acid", Journal of Polymer Science: Polymer Chemistry Edition, vol. 18, 1980, pp. 2755-2771.

European Search Report dated Oct. 10, 2014 in European Application No. 12786053.4.

* cited by examiner

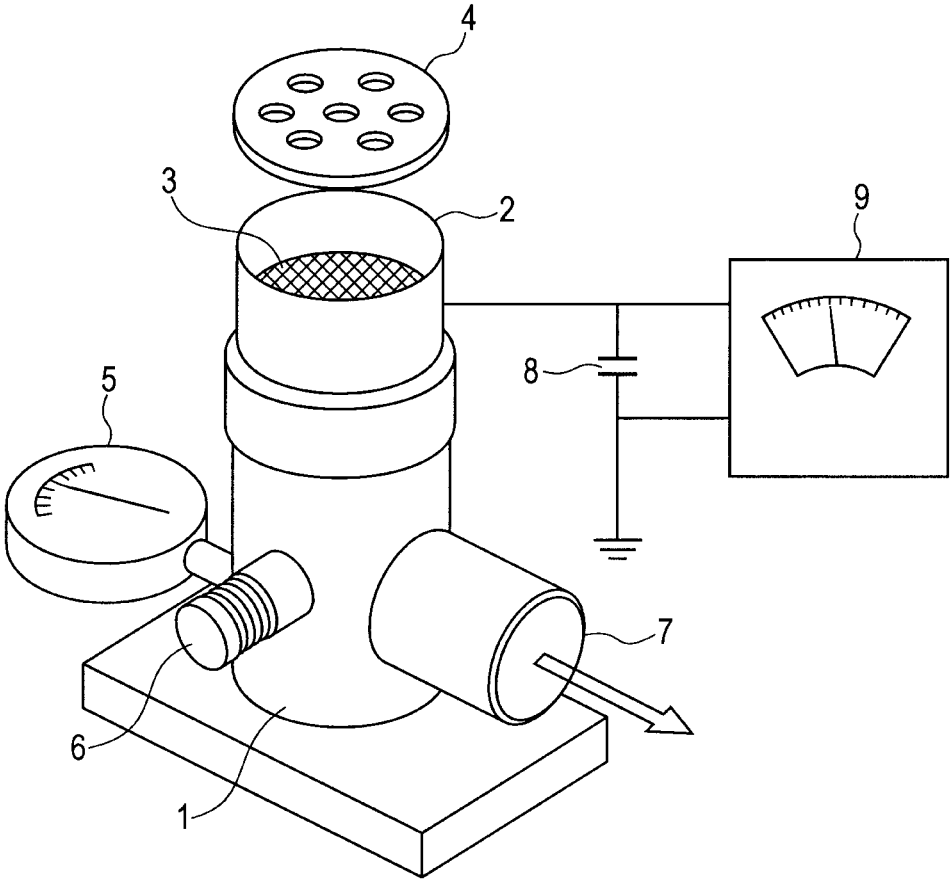
4
3
2
9
8
5
7
6
1

TONER

TECHNICAL FIELD

The present invention relates to an image forming methods such as electrophotography and electrostatic printing, or a toner for forming a toner image in a toner jet image forming method.

BACKGROUND ART

Improvement in frictional charging properties of the toner has been actively examined. Particularly, because of environmental concerns, a demand for more stable charging properties, and manufacturing cost, it is proposed these days that a resin having a charge control function (charge controlling resin) is used for a toner raw material. For example, a toner using a resin having a salicylic acid structure as the charge controlling resin has been proposed (PTL 1). According to the method, a toner having improved sublimation properties of salicylic acid and high charging properties can be obtained. Unfortunately, the toner leaves room for improvement along with increase in the process speed in copiers and printers. Particularly, in the case where the process speed is increased using a contact one-component developing system or the like, it is clarified that a charging ability (particularly, rise property in the initial charging) is insufficient. It is also clarified that there is room for improvement in stability of charging in printing out a large amount of sheets and stability of the charging amount under a high temperature and high humidity. Moreover, a toner using a resin containing a sulfonate group as a charge controlling resin has been proposed (PTL 2). According to the method, it is said that a toner that has a small change in the charging amount due to an environmental change and has stable charging properties is obtained. As a result of extensive research by the present inventors, however, it is clarified that the rise property is insufficient in the case where the process speed is increased using a contact one-component developing system or the like. It is also clarified that there is room for improvement in stability of charging in printing out a large amount of sheets and stability of the charging amount under a high temperature and high humidity.

CITATION LIST

Patent Literature

PTL 1: Japanese Patent No. 2694572
PTL 2: Japanese Patent No. 2807795

SUMMARY OF INVENTION

Technical Problem

The present invention has been made in consideration of the problems above. Namely, an object of the present invention is to provide a toner having high charging rapidity to reach a sufficient charging amount in a short time, high stability of charging from the initial stage to a time when a large amount of sheets is printed out, and high stability of charging under a high temperature and high humidity.

Solution to Problem

As a result of extensive research, the present inventors found out that the problems are solved by a toner according to the present invention, and thus achieved the present invention.

Namely, the present invention is a toner including toner particles, each of which contains a binder resin, a colorant, and a charge controlling resin, wherein the charge controlling resin is a polymer having at least a structure A represented by a formula (1) and a structure B represented by a formula (2):

Formula (1)

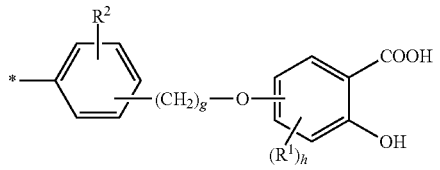

Formula (2)

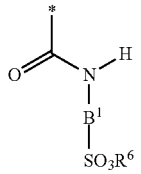

wherein $R^1$ represents a hydroxyl group, a carboxyl group, an alkyl group having not less than 1 and not more than 18 carbon atoms, or an alkoxyl group having not less than 1 and not more than 18 carbon atoms;

$R^2$ represents a hydrogen atom, a hydroxyl group, an alkyl group having not less than 1 and not more than 18 carbon atoms, or an alkoxyl group having not less than 1 and not more than 18 carbon atoms;

g represents an integer of not less than 1 and not more than 3; h represents an integer of not less than 0 and not more than 3; if h is 2 or 3, $R^1$ is each independently selected;

in the formula (2), $R^6$ represents a hydrogen atom or an alkyl group having not less than 1 and not more than 12 carbon atoms;

$B^1$ represents an alkylene structure that has 1 or 2 carbon atoms and may have a substituent, or an aromatic ring that may have a substituent; the substituent in the alkylene structure is a hydroxyl group, an alkyl group having not less than 1 and not more than 12 carbon atoms, an aryl group having 6 or 12 carbon atoms, or an alkoxyl group having not less than 1 and not more than 12 carbon atoms; the substituent in the aromatic ring is a hydroxyl group, an alkyl group having not less than 1 and not more than 12 carbon atoms, or an alkoxyl group having not less than 1 and not more than 12 carbon atoms; and

* sites in the structure A and the structure B are coupling sites in the polymer.

Advantageous Effects of Invention

The present invention can provide a toner having high charging rapidity to reach a sufficient charging amount in a short time, high stability of charging from the initial stage to a time when a large amount of sheets is printed out, and high stability of charging under a high temperature and high humidity.

Further features of the present invention will become apparent from the following description of exemplary embodiments with reference to the attached drawing.

BRIEF DESCRIPTION OF DRAWING

FIG. 1 is a drawing illustrating a configuration of an apparatus used for measuring a frictional charging amount of a developer using a toner according to the present invention.

DESCRIPTION OF EMBODIMENTS

The present inventors found out that in the toner including toner particles containing a binder resin, a colorant, and a charge controlling resin, if a copolymer having the structure A represented by the formula (1) and the structure B represented by the formula (2) (hereinafter, abbreviated to a polymer in some cases) is used as the charge controlling resin, a toner having high charging rapidity to reach a sufficient charging amount in a short time, high stability of charging from the initial stage to a time when a large amount of sheets is printed out, and high stability of charging under a high temperature and high humidity can be obtained. Thus, the present invention has been achieved.

Formula (1)

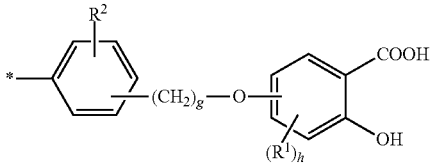

Formula (2)

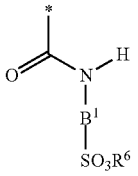

wherein $R^1$ represents a hydroxyl group, a carboxyl group, an alkyl group having not less than 1 and not more than 18 carbon atoms, or an alkoxyl group having not less than 1 and not more than 18 carbon atoms; $R^2$ represents a hydrogen atom, a hydroxyl group, an alkyl group having not less than 1 and not more than 18 carbon atoms, or an alkoxyl group having not less than 1 and not more than 18 carbon atoms; g represents an integer of not less than 1 and not more than 3; h represents an integer of not less than 0 and not more than 3; if h is 2 or 3, $R^1$ is each independently selected; $R^6$ represents a hydrogen atom or an alkyl group having not less than 1 and not more than 12 carbon atoms; $B^1$ represents an alkylene structure that has 1 or 2 carbon atoms and may have a substituent, or an aromatic ring that may have a substituent; the substituent in the alkylene structure is a hydroxyl group, an alkyl group having not less than 1 and not more than 12 carbon atoms, an aryl group having 6 or 12 carbon atoms, or an alkoxyl group having not less than 1 and not more than 12 carbon atoms; the substituent in the aromatic ring is a hydroxyl group, an alkyl group having not less than 1 and not more than 12 carbon atoms, or an alkoxyl group having not less than 1 and not more than 12 carbon atoms; and * sites in the structure A and the structure B are coupling sites in the polymer.

Although the mechanism is unclear how high effects are demonstrated in the charging rapidity to reach a sufficient charging amount in a short time, the stability of charging from the initial stage to a time when a large amount of sheets is printed out, and the stability of charging under a high temperature and high humidity, the present inventors think that the charging ability of the charge controlling resin having a charge control function is related to:

(A) the effect of generating and accumulating charges, and (B) a rate of dissipating charges, which the inventors think contributes to uniform charges.

It is found out that if a copolymer is formed in which the structure A represented by the formula (1) and having a salicylic acid derivative structure and the structure B represented by the formula (2) and having a sulfonic acid or sulfonic acid ester as a substituent coexist, an ability to generate and accumulate charges and provide uniform charges is demonstrated. Although the mechanism is unclear, it is thought that the structure A represented by the formula (1) and having a salicylic acid derivative contributes to dissipation of charges excessively accumulated in the structure B to properly provide uniform charges in the resin. In the charge controlling resin in the present invention, the structure A and the structure B exist in the same polymer. Accordingly, the structure A and the structure B exist closely in a molecular level. For this reason, it is thought that the charges are generated and made uniform instantaneously, resulting in quick rise of charging.

Although the mechanism is unclear, the present inventors think as follows. The structure A represented by the formula (1) and having a salicylic acid derivative structure has a salicylic acid structure and an aromatic ring bonded to the salicylic acid structure via alkyl ether having advantages in conduction of electrons. It is thought that the large conjugated system extending from the salicylic acid derivative improves a rate of providing and receiving the charges to improve the rise property in charging. Moreover, the aromatic ring is provided via alkyl ether between the main chain and the salicylic acid derivative structure to provide high structural flexibility. It is thought that this provides the effect of readily providing a molecular configuration such that the charges are provided and received between the structure A and the structure B represented by the formula (2) and having a sulfonic acid or sulfonic acid ester as a substituent more advantageously. As a result, it is thought that the effect of dissipating the charges excessively accumulated in the structure B more instantaneously is provided and the effect of instantaneously generating the charges and making the charges uniform is provided more efficiently than in the case where the salicylic acid derivative structure is directly provided in the main chain.

In the toner according to the present invention, the main chain structure of the polymer in the charge controlling resin is not particularly limited. Examples of the charge controlling resin include vinyl polymers, polyester polymers, polyamide polymers, polyurethane polymers, and polyether polymers. Preferred are polyester polymers or vinyl polymers considering easiness in production of the charge controlling resin in the present invention and merits in cost.

As the charge controlling resin in the toner according to the present invention, the structure A represented by the formula (1) preferably exists in the polymer as a partial structure represented by the formula (3). The structure B represented by the formula (2) preferably exists in the polymer as a partial structure represented by the formula (4).

Formula (3)

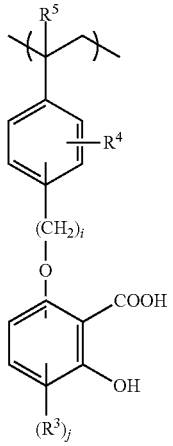

wherein $R^3$ represents a hydroxyl group, a carboxyl group, an alkyl group having not less than 1 and not more than 18 carbon atoms, or an alkoxyl group having not less than 1 and not more than 18 carbon atoms; $R^4$ represents a hydrogen atom, a hydroxyl group, an alkyl group having not less than 1 and not more than 18 carbon atoms, or an alkoxyl group having not less than 1 and not more than 18 carbon atoms; $R^5$ represents a hydrogen atom or a methyl group; i represents an integer of not less than 1 and not more than 3; j represents an integer of not less than 0 and not more than 3; if j is 2 or 3, $R^3$ is each independently selected;

Formula (4)

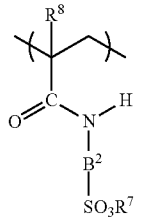

wherein $R^7$ represents a hydrogen atom or an alkyl group having not less than 1 and not more than 12 carbon atoms; $R^8$ represents a hydrogen atom or a methyl group; $B^2$ represents an alkylene structure that has 1 or 2 carbon atoms and may have a substituent, or an aromatic ring that may have a substituent; the substituent in the alkylene structure is a hydroxyl group, an alkyl group having not less than 1 and not more than 12 carbon atoms, an aryl group having 6 or 12 carbon atoms, or an alkoxyl group having not less than 1 and not more than 12 carbon atoms; the substituent in the aromatic ring is a hydroxyl group, an alkyl group having not less than 1 and not more than 12 carbon atoms, or an alkoxyl group having not less than 1 and not more than 12 carbon atoms.

In the case of the structures represented by the formulas (3) and (4), the effect of the present invention is more suitably demonstrated in toner particles containing a vinyl resin as a principal component.

If the main chain in the structure A represented by the formula (3) or the structure B represented by the formula (4) is a vinyl polymer, the vinyl polymer is likely to be miscible in the toner particles containing a vinyl resin as a principal component. By this miscibility, the structure A and the structure B exist with a distance therebetween being kept equivalent to some extent, enabling a more optimal molecular configuration. It is thought that the effect of the present invention is more remarkable for this reason.

For the same reason, other structure that forms the charge controlling resin in the present invention is preferably a unit derived from a vinyl monomer.

Moreover, if the main chain is a vinyl copolymer, the glass transition temperature (Tg) of the charge controlling resin can be easily controlled. Accordingly, while fixing properties of the toner are kept, the effect of the present invention can be demonstrated, leading to a preferred embodiment.

The charge controlling resin in the toner according to the present invention can be a polymer having a polyester structure. In this case, the main chain may be a polyester structure produced by polycondensation of a polyhydric alcohol component with a polyvalent carboxylic acid component, and the structure A represented by the formula (1) and the structure B represented by the formula (2) may be contained. As the resin having a polyester structure, a hybrid resin modified with a vinyl monomer can be used.

In the case where the hybrid resin is used, a known method may be used to control the modification ratio with vinyl in the hybrid resin. Specifically, the ratio of the polyester resin component to the vinyl monomer component to be added can be changed to control the modification ratio with vinyl to any modification ratio. In the case where the hybrid resin is used, the salicylic acid derivative structure A represented by the formula (1) and the structure B represented by the formula (2) and having a sulfonic acid or sulfonic acid ester as a substituent may exist in one of the vinyl resin unit and the polyester resin unit. The structure A and the structure B may exist in the side chain or the terminal.

Examples of a polyhydric alcohol component that forms a resin containing the polyester structure include the followings. Specifically, examples of a dihydric alcohol component include alkylene oxide adducts of bisphenols A such as polyoxypropylene(2.2)-2,2-bis(4-hydroxyphenyl)propane, polyoxypropylene(3.3)-2,2-bis(4-hydroxyphenyl)propane, polyoxyethylene(2.0)-2,2-bis(4-hydroxyphenyl)propane, polyoxypropylene(2.0)-polyoxyethylene(2.0)-2,2-bis(4-hydroxyphenyl)propane, and polyoxypropylene(6)-2,2-bis(4-hydroxyphenyl)propane and hydrogenated bisphenols A such as ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, polytetramethylene glycol, bisphenol A.

Examples of trihydric or more alcohol components include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methyl propanetriol, 2-methyl-1,2,4-butanetriol, trimethylolethane, trimethylolpropane, and 1,3,5-trihydroxymethylbenzene.

Examples of the polyvalent carboxylic acid component include aromatic dicarboxylic acids such as phthalic acid, isophthalic acid, and terephthalic acid or anhydrides thereof; alkyl dicarboxylic acids such as succinic acid, adipic acid, sebacic acid, and azelaic acid or anhydrides thereof; succinic acid replaced with an alkyl group having not less than 6 and not more than 12 carbon atoms or anhydrides thereof; and unsaturated dicarboxylic acids such as fumaric acid, maleic acid and citraconic acid or anhydrides thereof.

Among these, polyester resins obtained by condensation polymerization of a bisphenol derivative as a diol component with a carboxylic acid component including a carboxylic acid having a valence of 2 or more, an acid anhydride thereof, or a lower alkyl ester thereof (such as fumaric acid, maleic acid, maleic anhydride, phthalic acid, terephthalic acid, trimellitic acid, and pyromellitic acid) as an acid component can be particularly preferably used.

A method for producing a charge controlling resin is not particularly limited, and the charge controlling resin can be produced by a known method. In the case of the vinyl resin, for example, a polymerizable monomer including the structure A represented by the formula (1) (formula (5)) may be copolymerized with a polymerizable monomer including the structure B having the structure represented by the formula (2) (formula (6)) using a polymerization initiator.

Formula (5)

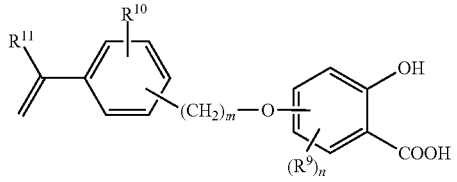

-continued

Formula (6)

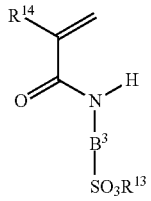

In the formula (5), $R^9$ represents a hydroxyl group, a carboxyl group, an alkyl group having not less than 1 and not more than 18 carbon atoms, or an alkoxyl group having not less than 1 and not more than 18 carbon atoms; $R^{10}$ represents a hydrogen atom, a hydroxyl group, an alkyl group having not less than 1 and not more than 18 carbon atoms, or an alkoxyl group having not less than 1 and not more than 18 carbon atoms; $R^{11}$ represents a hydrogen atom or a methyl group; m represents an integer of not less than 1 and not more than 3; n represents an integer of not less than 0 and not more than 3; if n is 2 or 3, $R^9$ is each independently selected; wherein $R^{13}$ represents a hydrogen atom or an alkyl group having not less than 1 and not more than 12 carbon atoms; $R^{14}$ represents a hydrogen atom or a methyl group; $B^3$ represents an alkylene structure that has 1 or 2 carbon atoms and may have a substituent, or an aromatic ring that may have a substituent; the substituent in the alkylene structure is a hydroxyl group, an alkyl group having not less than 1 and not more than 12 carbon atoms, an aryl group having 6 or 12 carbon atoms, or an alkoxyl group having not less than 1 and not more than 12 carbon atoms; the substituent in the aromatic ring is a hydroxyl group, an alkyl group having not less than 1 and not more than 12 carbon atoms, or an alkoxyl group having not less than 1 and not more than 12 carbon atoms.

Specific examples of the polymerizable monomer usable as the structure A (formula (5)) can include the followings. The examples shown here are only examples, and the compound will not be limited to these.

TABLE 1

| Polymerizable monomer | Formula | R9 H, OH, COOH, alkyl group or alkoxyl group having 1 to 18 carbon atoms | R10 H, OH, COOH, alkyl group or alkoxyl group having 1 to 18 carbon atoms | R11 H or methyl group | m 1-3 | n 1-3 |
|---|---|---|---|---|---|---|
| M-1 | 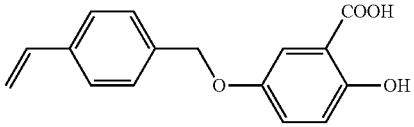 | H | H | H | 1 | 1 |
| M-2 | 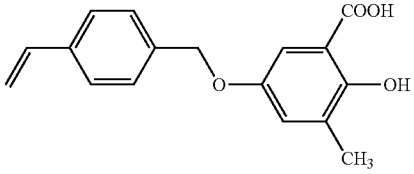 | 3-Me | H | H | 1 | 1 |

TABLE 1-continued
| Polymerizable monomer | Formula | R9 H, OH, COOH, alkyl group or alkoxyl group having 1 to 18 carbon atoms | R10 H, OH, COOH, alkyl group or alkoxyl group having 1 to 18 carbon atoms | R11 H or methyl group | m 1-3 | n 1-3 |
|---|---|---|---|---|---|---|
| M-3 | 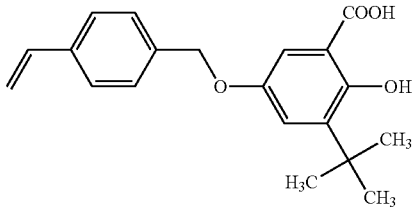 | 3-tert-Butyl | H | H | 1 | 1 |
| M-4 | 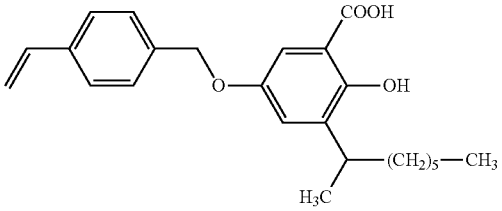 | 3-iso-Octyl | H | H | 1 | 1 |
| M-5 | 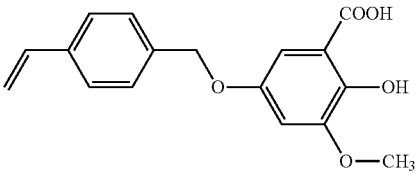 | 3-MeO | H | H | 1 | 1 |
| M-6 | 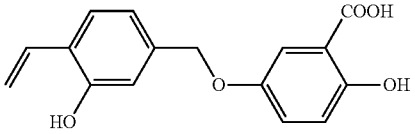 | H | 3-OH | H | 1 | 1 |
| M-7 | 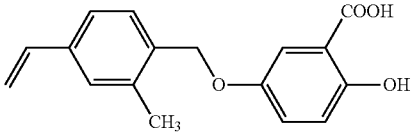 | H | 2-Me | H | 1 | 1 |
| M-8 | 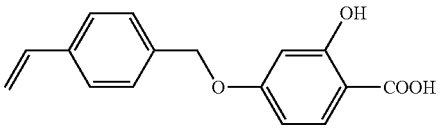 | H | H | H | 1 | 1 |
| M-9 | 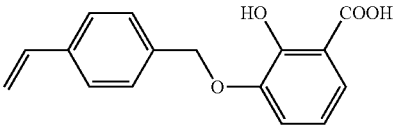 | H | H | H | 1 | 1 |
| M-10 | 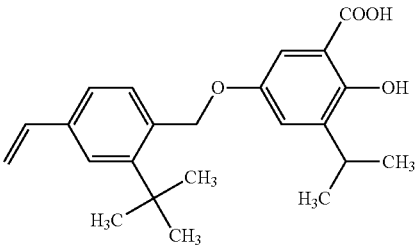 | 3-iso-Propyl | 2-tert-Butyl | H | 1 | 1 |

TABLE 1-continued

| Polymerizable monomer | Formula | R9 H, OH, COOH, alkyl group or alkoxyl group having 1 to 18 carbon atoms | R10 H, OH, COOH, alkyl group or alkoxyl group having 1 to 18 carbon atoms | R11 H or methyl group | m 1-3 | n 1-3 |
|---|---|---|---|---|---|---|
| M-11 | 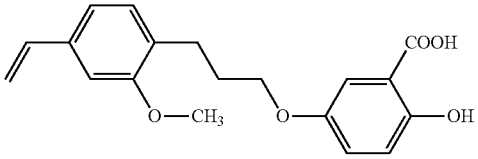 | H | 2-MeO | H | 3 | 1 |

Specific examples of the polymerizable monomer usable as the structure B (formula (6)) can include the followings: 2-acrylamide-2-methylpropanesulfonic acid, 2-acrylamidebenzenesulfonic acid, 2-methacrylamidebenzenesulfonic acid, 3-acrylamidebenzenesulfonic acid, 3-methacrylamidebenzenesulfonic acid, 4-acrylamidebenzenesulfonic acid, 4-methacrylamidebenzenesulfonic acid, 2-acrylamide-5-methylbenzenesulfonic acid, 2-methacrylamide-5-methylbenzenesulfonic acid, 2-acrylamide-5-methoxybenzenesulfonic acid, 2-methacrylamide-5-methoxybenzenesulfonic acid, and alkyl esters of those having not less than 1 and not more than 12 carbon atoms. Preferable is a sulfonic acid structure, methyl esters or ethyl esters, and more preferable is a sulfonic acid structure or a sulfonic acid methyl ester structure.

In the case where the main chain of the charge controlling resin is a vinyl copolymerized resin, usable other vinyl monomer is not particularly limited. Specifically, examples thereof can include the following compounds: styrenes such as styrene, o-methylstyrene, m-methylstyrene, p-methylstyrene, and α-methylstyrene and derivatives thereof; ethylene unsaturated monoolefins such as ethylene, propylene, butylene, and isobutylene; halogenated vinyls such as vinyl chloride, vinylidene chloride, vinyl bromide, and vinyl fluoride; vinyl ester acids such as vinyl acetate, vinyl propionate, and vinyl benzoate; acrylic acid esters such as n-butyl acrylate and 2-ethylhexyl acrylate; methacrylic acid esters such as n-butyl methacrylate and 2-ethylhexyl methacrylate; methacrylic acid amino esters such as dimethylaminoethyl methacrylate and diethylaminoethyl methacrylate; vinyl ethers such as vinyl methyl ether and vinyl ethyl ether; vinyl ketones such as vinyl methyl ketone; N-vinyl compounds such as N-vinyl pyrrole; vinylnaphthalenes; acrylonitrile, (meth)acrylonitrile, and acrylamide; and acrylic acids and methacrylic acids.

Examples of a polymerization initiator usable for copolymerization of the polymerizable monomer component above include various polymerization initiators such as peroxide polymerization initiators and azo polymerization initiators. Examples of organic peroxide polymerization initiators to be used include peroxy esters, peroxydicarbonates, dialkyl peroxides, peroxyketals, ketone peroxides, hydroperoxides, and diacyl peroxides. Examples of inorganic peroxide polymerization initiators include persulfate and hydrogen peroxide. Specifically, examples thereof include peroxyesters such as t-butyl peroxyacetate, t-butyl peroxypivalate, t-butyl peroxyisobutyrate, t-hexyl peroxyacetate, t-hexyl peroxypivalate, t-hexyl peroxyisobutyrate, t-butyl peroxyisopropyl monocarbonate, and t-butyl peroxy 2-ethylhexylmonocarbonate; diacyl peroxides such as benzoyl peroxide; peroxydicarbonates such as diisopropyl peroxydicarbonate; peroxyketals such as 1,1-di-t-hexylperoxycyclohexane; dialkyl peroxides such as di-t-butyl peroxide; and t-butyl peroxyallylmonocarbonate. Examples of the azo polymerization initiators to be used include 2,2'-azobis-(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile, azobisisobutyronitrile, and dimethyl-2,2'-azobis(2-methylpropionate).

When necessary, two or more of these polymerization initiators can be used at the same time. At this time, the amount of the polymerization initiator to be used is preferably not less than 0.1 parts by mass and not more than 20.0 parts by mass based on 100 parts by mass of the polymerizable monomer. The polymerization method is not particularly limited, and any method of solution polymerization, suspension polymerization, emulsion polymerization, dispersion polymerization, precipitation polymerization, and bulk polymerization can be used.

On the other hand, in the case where the main chain of the charge controlling resin is a polyester resin, various known production methods can be used. Examples of the methods can include:

(A) a method in which reaction residues of carboxyl groups and hydroxyl groups contained in the polyester structure are used and converted by an organic reaction into the structure A having the structure represented by the formula (1) as a substituent and the structure B having the structure represented by the formula (2);

(B) a method in which polyester is produced using a polyhydric alcohol or a polyvalent carboxylic acid having the structure A having the structure represented by the formula (1) as a substituent and the structure B having the structure represented by the formula (2); and (C) a method in which a functional group that facilitates introduction of the structure A having the structure represented by the formula (1) as a substituent and the structure B having the structure represented by the formula (2) is introduced into a polyhydric alcohol or a polyvalent carboxylic acid in advance.

In the case where the main chain of the charge controlling resin is the hybrid resin, examples of the methods can include:

(D) a method in which the polyester resin containing the structure A having the structure represented by the formula (1) as a substituent and the structure B having the structure represented by the formula (2) is hybridized by a vinyl monomer;

(E) a method in which a vinyl monomer having a carboxyl group such as acrylic acid and methacrylic acid is polymerized, and the carboxyl group is converted into the structure A represented by the formula (1) or the structure B represented by the formula (2) by an organic reaction; and (F) a method in which a polyester resin is hybridized using a vinyl monomer having the structure A represented by the formula (1) and the structure B represented by the formula (2).

A known method can be used as the method for hybridizing a polyester resin using a vinyl monomer, and is effective as the method (D). Specifically, examples of the method include a method of vinyl modifying polyester with a peroxide initiator, and a method of graft modifying a polyester resin having an unsaturated group to produce a hybrid resin.

Examples of a specific method of (E) can include a method in which when the structure represented by the formula (1) is introduced by an organic reaction, a carboxyl group existing in the resin is amidated using a compound having a salicylic acid structure as follows:

Formula (7)

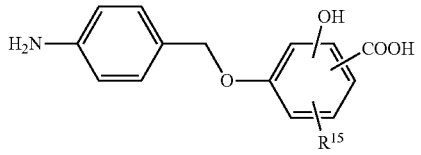

wherein, in the formula (7), COOH and OH are bonded to adjacent sites, and $R^{15}$ is arbitrarily selected from a hydrogen atom, a hydroxyl group, a carboxyl group, an alkyl group having not less than 1 and not more than 18 carbon atoms, or an alkoxyl group having not less than 1 and not more than 18 carbon atoms.

In the case where the structure represented by the formula (2) is introduced, examples of the method can include a method in which a carboxyl group existing in the resin is amidated using a compound having a sulfonate group such as aminomethanesulfonic acid, aminoethanesulfonic acid (taurine), and 2-aminobenzenesulfonic acid and an amino group, and sulfonic acid is further esterified by a known esterification agent.

As a specific method of (F), the polymerizable monomer represented by the formula (5) can be used as a usable vinyl monomer having a salicylic acid derivative structure A represented by the formula (1). As a usable vinyl monomer having the structure B represented by the formula (2) and having a sulfonic acid or sulfonic acid ester as a substituent, the polymerizable monomer represented by the formula (6) can be used.

The content a (μmol/g) of the structure A represented by the formula (1) in the toner and the content b (μmol/g) of the structure B represented by the formula (2) in the toner preferably satisfy the relationship of $0.10 \leq a/b \leq 10.0$. If the contents a and b are within the range above, uniform charging is provided more quickly. Although the mechanism is unclear, it is thought that at a molar ratio a/b of not less than 0.10, occurrence of charge up can be more effectively suppressed as a toner. It is also thought that at a molar ratio a/b of not more than 10.0, an influence of moisture absorbing properties that the structure A represented by the formula (1) has can be suppressed to provide a desired charging amount to the toner more effectively.

Preferably, the content b is not less than 0.100 μmol/g. If the content b in the toner is not less than 0.100 μmol/g, the toner sufficiently has portions in which the charges are generated and accumulated. As a result, a desired charging amount can be provided to the toner.

As a method of controlling the molar ratio a/b of the content a of the structure A to the content b of the structure B in the toner in the range of not less than 0.10 and not more than 10.0, and the content b in the toner in the range of not less than 0.100 μmol/g, control can be performed by the following method, for example.

In the case of the vinyl resin, in production of the charge controlling resin, the amounts of the polymerizable monomer having the structure A represented by the formula (1) (formula (5)) and the polymerizable monomer having the structure B having the structure represented by the formula (2) (formula (6)) to be added are controlled such that the content a of the structure A and the content b of the structure B are within the ranges above. Then, polymerization is performed by the method above. It is checked that the molar ratio a/b of the content a of the structure A to the content b of the structure B in the obtained charge controlling resin is not less than 0.10 and not more than 10.0. Then, an amount of the charge controlling resin is further added to the toner such that the content b in the toner is not less than 0.100 μmol/g. Thereby, the desired molar ratio a/b and content b can be attained.

Also in the case of the polyester resin, in production of the charge controlling resin, the charge controlling resin is produced such that the content a of the structure A and the content b of the structure B are within the ranges above. Then, an amount of the charge controlling resin is further added to the toner such that the content b in the toner is not less than 0.100 μmol/g. Thereby, the desired molar ratio a/b and content b can be attained.

In the present invention, the content (μmol/g) of the structure A in the polymer can be determined by a method described later. First, the polymer is titrated by the method described later to determine the amount of a hydroxyl value in the polymer. Then, the amount of the hydroxyl group that the polymer has is calculated, the hydroxyl value being derived from the structure A. Based on the calculated amount, the content (μmol/g) of the structure A in the polymer is calculated. If the polymer has a hydroxyl group in a portion other than the structure A, the amount of the hydroxyl value in a compound immediately before the structure A is subjected to an addition reaction in production of the polymer (for example, a polyester resin) is measured in advance. The amount of the structure A to be added can be calculated from the difference between the amount of the hydroxyl value in the polymer before the addition reaction and that after the addition reaction.

In the present invention, the content (μmol/g) of the structure B in the toner and the content (μmol/g) of the structure B in the polymer are calculated as follows. By an element analysis of a polymer B, the amount of a sulfur element derived from the structure B and existing in 1 g of the polymer B is calculated. The amount of a sulfur element is divided by 32.06 (the amount of S atoms) to calculate the content (μmol/g) of the structure B per 1 g of the polymer B. As for the content (μmol/g) of the structure B in the toner, by an element analysis of the toner, the amount of a sulfur element derived from the structure B and existing in 1 g of the toner is calculated. The amount of a sulfur element is divided by 32.06 (the amount of sulfur atoms) to calculate the content (μmol/g) of the structure B per 1 g of the toner. The molar ratio a/b of the structure A to the structure B in the toner can be determined from the content (μmol/g) of the structure A calculated from the hydroxyl value in the polymer and the content (μmol/g) of the structure B calculated from the amount of a sulfur element.

A known method can be used as a method for controlling the weight average molecular weight of the charge controlling resin in the toner according to the present invention.

In the vinyl resin, the weight average molecular weight can be arbitrarily controlled by the ratio of the amount of the vinyl monomer to that of a radical initiator to be added and the polymerization temperature.

In the polyester resin, the weight average molecular weight can be arbitrarily controlled by the ratio of the amount of the acid component to that of the alcohol component to be added, and the polymerization time. In the hybrid resin, in addition to the molecular weight of the polyester component, the molecular weight of the vinyl modified unit can also be controlled. Specifically, in a vinyl modification reaction step, the molecular weight can be arbitrarily controlled by the amount of the radical initiator and the polymerization temperature. The vinyl monomers above can be used as the vinyl monomer that can be used to hybridize the polyester resin in the present invention.

Preferably, the weight average molecular weight of the charge controlling resin is not less than 1000 and not more than 1000000, the weight average molecular weight being calculated by gel permeation chromatography (GPC). A more preferred range of the weight average molecular weight is not less than 2000 and not more than 200000. If the molecular weight of the charge controlling resin has a molecular weight within the range above, contamination of a member such as a sleeve and a carrier is well suppressed.

From the viewpoint of charging properties and fixing properties, the charge controlling resin preferably has narrow distribution of the molecular weight.

Preferably, the ratio (Mw/Mn) of the weight average molecular weight Mw to the number average molecular weight Mn is not less than 1.0 and not more than 6.0, the Mw and the Mn being calculated by gel permeation chromatography. More preferably, the ratio is not less than 1.0 and not more than 4.0.

Next, the toner will be described below.

The toner according to the present invention is a toner including toner particles containing a binder resin, a colorant, and a charge controlling resin, wherein the charge controlling resin contains the structure A represented by the formula (1) and the structure B represented by the formula (2).

Preferably, the charge controlling resin is added separately from a resin used as the binder resin. The content of the charge controlling resin is not particularly limited, and the content is preferably not less than 0.05 parts by mass and not more than 20.0 parts by mass based on 100 parts by mass of the binder resin. At a content within the range above, high dispersibility in the toner particles is provided to obtain a sufficient effect of addition of the charge controlling resin.

The binder resin used in the toner according to the present invention is not particularly limited. In production of the toner particles by the suspension polymerization, a polymerizable monomer can be polymerized to be formed as the binder resin. In this case, the polymerizable monomer is not particularly limited, and the vinyl monomer is suitably used. At this time, in addition to the polymerizable monomer, a vinyl resin or a polyester resin can be further added to the monomer composition to prepare a material that forms the binder resin. Examples of the vinyl resin that can be used as the binder resin in the toner according to the present invention can include: styrene resins, acrylic resins, methacrylic resins, styrene-acrylic resins, styrene-methacrylic resins, polyethylene resins, polyethylene-vinyl acetate resins, vinyl acetate resins, and polybutadiene resins.

As the polyester resin, polyester resins usually produced using polyhydric alcohol and carboxylic acid, carboxylic anhydride, or carboxylic acid ester as raw material monomers can be used. Specifically, the same polyhydric alcohol components and polyvalent carboxylic acid components as those in the description of the polyester resin can be used. Among these, particularly preferred are polyester resins obtained by condensation polymerizing the following components. Namely, the component is carboxylic acid components including bisphenol derivatives as a diol component; and lower alkylesters such as divalent or more carboxylic acids or acid anhydrides thereof; fumaric acid, maleic acid, maleic anhydride, phthalic acid, terephthalic acid, trimellitic acid, and pyromellitic acid as an acid component.

Other than the vinyl resin and the polyester resin, phenol resins, polyurethane resins, polybutyral resins, and hybrid resin obtained by arbitrarily bonding these resins can also be used.

Among these, the followings are desirably used for toner properties: styrene resins, acrylic resins, methacrylic resins, styrene-acrylic resins, styrene-methacrylic resins, polyester resins, and hybrid resins obtained by bonding a styrene-acrylic resin or a styrene-methacrylic resin to a polyester resin.

The toner according to the present invention may contain a mold release agent. Examples of the mold release agent include aliphatic hydrocarbon waxes such as low molecular weight polyethylenes, low molecular weight polypropylenes, microcrystalline waxes, and paraffin waxes; oxides of aliphatic hydrocarbon waxes such as oxidized polyethylene waxes; block copolymers of aliphatic hydrocarbon waxes; waxes containing fatty acid esters as a principal component such as carnauba wax, Sasolwax, and montanic acid ester waxes; partially or totally deoxidized fatty acid esters such as deacidified carnauba wax, and partially esterified products of fatty acids such as behenic acid monoglyceride and polyhydric alcohols; and methyl ester compounds having a hydroxyl group that are obtained by hydrogenated vegetable oils and fats.

In the molecular weight distribution of the mold release agent, the main peak of the molecular weight is preferably in the range of not less than 400 and not more than 2400, and more preferably in the range of not less than 430 and not more than 2000. Thereby, preferred thermal properties can be given to the toner. The amount of the mold release agent to be added is preferably not less than 2.5 parts by mass and not more than 40.0 parts by mass, and more preferably not less than 3.0 parts by mass and not more than 15.0 parts by mass based on 100 parts by mass of the binder resin.

Examples of the colorant that can be used for the toner according to the present invention can include known colorants such as various conventionally known dyes and pigments in the related art.

Examples of coloring pigments for magenta include C.I. Pigment Reds 3, 5, 17, 22, 23, 38, 41, 112, 122, 123, 146, 149, 178, 179, 190, and 202, and C.I. Pigment Violets 19 and 23. These pigments may be used alone, or may be used in combination with dyes and pigments.

Examples of coloring pigments for cyan include C.I. Pigment Blues 15, 15:1, and 15:3 or copper phthalocyanine pigments having 1 to 5 phthalimidomethyl groups replaced in a phthalocyanine skeleton.

Examples of coloring pigments for yellow include C.I. Pigment Yellows 1, 3, 12, 13, 14, 17, 55, 74, 83, 93, 94, 95, 97, 98, 109, 110, 154, 155, 166, 180, and 185.

As a black colorant, carbon black, aniline black, acetylene black, titanium black, and colorants prepared by using the yellow/magenta/cyan colorants shown above and toning the color to black can be used.

Moreover, the toner according to the present invention can also be used as a magnetic toner. In this case, magnetic bodies shown below are used: iron oxides such as magnetite, maghemite, and ferrite, or iron oxides containing other metal oxide; metals such as Fe, Co, and Ni, or alloys of these metals and metals such as Al, Co, Cu, Pb, Mg, Ni, Sn, Zn, Sb, Ca, Mn, Se, and Ti, and a mixture thereof; triiron tetraoxide ($Fe_3O_4$), diiron trioxide ($\gamma$-$Fe_2O_3$), zinc iron oxide ($ZnFe_2O_4$), copper iron oxide ($CuFe_2O_4$), neodymium iron oxide ($NdFe_2O_3$), barium iron oxide ($BaFe_{12}O_{19}$), magnesium iron oxide ($MgFe_2O_4$), and manganese iron oxide ($MnFe_2O_4$). The magnetic materials above are used alone, or two or more thereof are used in combination. Particularly suitable magnetic materials are fine powder of triiron tetraoxide or $\gamma$-diiron trioxide.

These magnetic bodies preferably have an average particle size of not less than 0.1 μm and not more than 1.0 μm, and more preferably have an average particle size of not less than 0.1 μm and not more than 0.3 μm. As the magnetic properties at 795.8 kA/m (10 KOe), the coercivity (Hc) is not less than 1.6 kA/m and not more than 12 kA/m (not less than 20 Oe and not more than 150 Oe); the saturation magnetization ($\tau s$) is not less than 5 $Am^2/kg$ and not more than 200 $Am^2/kg$, and preferably not less than 50 $Am^2/kg$ and not more than 100 $Am^2/kg$. The residual magnetization ($\tau r$) is preferably not less than 2 $Am^2/kg$ and not more than 20 $Am^2/kg$.

The amount of the magnetic body to be used is in the range of not less than 10 parts by mass and not more than 200 parts by mass, and preferably the range of not less than 20 parts by mass and not more than 150 parts by mass based on 100 parts by mass of the binder resin.

A method for producing a toner is not particularly limited, and known methods can be used. Specifically, examples of the method include:

(A) a method in which using suspension polymerization described in Japanese Patent Publication No. S36-10231 and Japanese Patent Application Laid-Open Nos. 559-53856 and S59-61842, toner particles are directly produced;

(B) a method such as a microcapsule production method of producing toner particles by interface polymerization;

(C) a method of producing a toner by a coacervation method;

(D) a method for obtaining toner particles by association polymerization in which at least one or more fine particles are aggregated to provide a desired particle size, as described in Japanese Patent Application Laid-Open Nos. S62-106473 and S63-186253;

(E) a method of producing toner particles by dispersion polymerization characterized by providing monodisperse;

(F) polymer dissolution (melt) suspension in which necessary resins are dissolved in a water-insoluble organic solvent, and formed into a toner in water;

(G) a method for obtaining toner particles by emulsion dispersion;

(H) a crushing method in which using a pressure kneader, an extruder, or a medium dispersing machine, toner components are kneaded to be uniformly dispersed, and cooled; the kneaded product is collided to a target mechanically or under a jet stream to be pulverized into a desired toner particle size; further, the pulverized product is classified in a classifying to provide toner particles having sharp distribution of a particle size; and (I) a method for obtaining toner particles in which the toner obtained by the crushing method is, for example, heated in a solvent to form into a spherical shape.

Among these, production of the toner particles by the suspension polymerization demonstrates a particularly remarkable effect of the present invention. The reason is that the charge controlling resin can be effectively localized in the vicinity of the surfaces of the toner particles in a step (granulation step) of granulation in an aqueous medium. The toner particles are toner particles obtained by adding a polymerizable monomer composition containing a polymerizable monomer and the charge controlling resin into an aqueous medium, granulating the polymerizable monomer composition in the aqueous medium to form particles of the polymerizable monomer composition, and polymerizing the polymerizable monomer contained in the particles.

In the method of producing toner particles by the suspension polymerization, first, a colorant is uniformly dissolved, mixed, or dispersed by a stirrer or the like in a polymerizable monomer that forms a binder resin. Particularly, in the case where the colorant is a pigment, the colorant is preferably treated by a dispersing machine to provide a pigment dispersed paste. The colorant together with the polymerizable monomer, the charge controlling resin, and the polymerization initiator, and wax or other additives when necessary, is uniformly dissolved or dispersed by a stirrer or the like to produce a polymerizable monomer composition. The thus-obtained polymerizable monomer composition is added to a disperse medium containing a disperse stabilizer (preferably an aqueous medium), and finely dispersed into a toner particle size using a high speed dispersing machine such as a high speed stirrer or an ultrasonic dispersing machine as a stirrer (granulation step). Then, the polymerizable monomer contained in the polymerizable monomer composition finely dispersed in the granulation step is subjected to a polymerization reaction by light or heat (polymerization step). Thereby, toner particles can be obtained. The polymerization initiator may be added after the granulation step.

A known method can be used as a method of dispersing a pigment in an organic medium. For example, when necessary, a resin and a pigment dispersant are dissolved in an organic medium. While the solution is stirred, pigment powder is gradually added and sufficiently mixed with the solvent. Further, a mechanical shear force is applied by a dispersing machine such as a ball mill, a paint shaker, a dissolver, an attritor, a sand mill, and a high speed mill. Thereby, the pigment can be stably finely dispersed, namely, dispersed in a state of uniform fine particles.

The same vinyl monomers usable in the charge controlling resin can be used as the polymerizable monomer that can be suitably used for the suspension polymerization.

In the production method, usable dispersion media are determined according to the solubility of the binder resin, an organic medium, the polymerizable monomer, and the charge controlling resin in the dispersion medium. Aqueous dispersion media are preferred. Examples of the aqueous dispersion medium that can be used include water; alcohols such as methyl alcohol, ethyl alcohol, modified ethyl alcohol, isopropyl alcohol, n-butyl alcohol, isobutyl alcohol, tert-butyl alcohol, and sec-butyl alcohol; and ether alcohols such as methyl cellosolve, cellosolve, isopropyl cellosolve, butyl cellosolve, and diethylene glycol monobutyl ether. Besides, water soluble dispersion media are selected from ketones such as acetone, methyl ethyl ketone, and methyl isobutyl ketone; esters such as ethyl acetate; ethers such as ethyl ether and ethylene glycol; acetals such as methylal and diethyl acetal; acids such as formic acid, acetic acid, and propionic acid. Particularly preferred is water or alcohols. Two or more of these solvents can be mixed and used. The concentration of a liquid mixture or polymerizable monomer composition to the dispersion medium is preferably not less than 1% by mass and not more than 80% by mass, and more preferably not less than 10% by mass and not more than 65% by mass based on the dispersion medium.

A known dispersion stabilizer can be used in the case where the aqueous dispersion medium is used. Specific examples of the dispersion stabilizer include inorganic compounds such as calcium phosphate, magnesium phosphate, aluminum phosphate, zinc phosphate, calcium carbonate, magnesium carbonate, calcium hydroxide, magnesium hydroxide, aluminum hydroxide, calcium metasilicate, calcium sulfate, barium sulfate, bentonite, silica, and alumina. As organic compounds, polyvinyl alcohol, gelatin, methyl cellulose, methyl hydroxypropyl cellulose, ethyl cellulose, sodium salts of carboxymethyl cellulose, polyacrylic acids and salts thereof, and starch can be dispersed in an aqueous phase and used. The concentration of the dispersion stabilizer is preferably not less than 0.2 parts by mass and not more than 20.0 parts by mass based on 100 parts by mass of the liquid mixture or the polymerizable monomer composition.

The same polymerization initiators usable in the charge controlling resin can be used as the polymerization initiator used for the toner according to the present invention in the case of using the suspension polymerization.

In the case where the toner is produced by the suspension polymerization, a known crosslinking agent may be added. A preferred amount of the crosslinking agent to be added is not less than 0 parts by mass and not more than 15.0 parts by mass based on 100 parts by mass of the polymerizable monomer.

A fluidity improver as an external additive may be added to the toner particles. Examples of the fluidity improver include fluorine resin powders such as vinylidene fluoride fine powder and polytetrafluoroethylene fine powder; silica fine powders such as silica fine powder produced by a wet method and silica fine powder produced by a dry method, treated silica fine powder obtained by surface treating these silica fine powders with a treatment agent such as a silane coupling agent, a titanium coupling agent, and silicone oil; titanium oxide fine powder; alumina fine powder, treated titanium oxide fine powder, and treated alumina oxide fine powder. The fluidity improver has a specific surface area of preferably not less than 30 $m^2/g$ and more preferably not less than 50 $m^2/g$, the specific surface area being measured by the BET method according to nitrogen adsorption. The amount of the fluidity improver to be used is not less than 0.01 parts by mass and not more than 8.0 parts by mass, and preferably not less than 0.1 parts by mass and not more than 4.0 parts by mass based on 100 parts by mass of the toner particles.

The weight average particle size (D4) of the toner is not less than 3.0 μm and not more than 15.0 μm, and preferably not less than 4.0 μm and not more than 12.0 μm.

The toner according to the present invention can be mixed with a magnetic carrier and used as a two-component developer. As the magnetic carrier, metal particles of surface-oxidized iron or non-oxidized iron, lithium, calcium, magnesium, nickel, copper, zinc, cobalt, manganese, chromium, and rare earth elements, particles of alloys thereof, particles of oxides thereof, and ferrite fine particles can be used.

In a developing method of applying an AC bias to a developing sleeve, the coated carrier having the surface of the magnetic carrier core coated with a resin is preferably used. As a coating method, used is a method of dissolving or suspending a coating material such as a resin in a solvent to prepare a coating solution and applying the coating solution to the surface of a magnetic carrier core, or a method of mixing a magnetic carrier core with a coating material in powder.

Examples of the coating material for the magnetic carrier core include silicone resins, polyester resins, styrene resins, acrylic resins, polyamides, polyvinyl butyrals, and amino acrylate resins. These are used alone, or two or more thereof are used in combination. The amount of the coating material to be used for coating treatment is not less than 0.1% by mass and not more than 30% by mass (preferably not less than 0.5% by mass and not more than 20% by mass) based on the carrier core particles.

The average particle size of the magnetic carrier is preferably not less than 10 μm and not more than 100 μm, and more preferably not less than 20 μm and not more than 70 μm in terms of a volume-based 50% particle size (D50).

In the case where the two-component developer is prepared, the mixing ratio of the toner in the developer in terms of a concentration is not less than 2% by mass and not more than 15% by mass, and preferably not less than 4% by mass and not more than 13% by mass. This mixing ratio provides a good result.

Hereinafter, methods for measuring physical properties will be described.

<Distribution of Molecular Weight of Charge Controlling Resin>

The molecular weight and molecular weight distribution of the charge controlling resin are calculated by gel permeation chromatography (GPC) in terms of polystyrene. In the case where the molecular weight of a resin having an acid group is measured, the column eluting rate also depends on the amount of the acid group. Accordingly, a sample having the acid group capped in advance needs to be prepared. Preferable capping is methyl esterification, and a commercially available methyl esterification agent can be used. Specifically, examples of methyl esterification include a method of treating with trimethylsilyldiazomethane.

The measurement of the molecular weight by GPC is performed as follows. First, a sample to be measured is dissolved in tetrahydrofuran (THF) at room temperature over 24 hours. The obtained solution is filtered with a membrane filter "MAESHORI DISK" (made by Tosoh Corporation) having a pore diameter of 0.2 μm and having solvent resistance to obtain a sample solution. The sample solution is prepared such that the concentration of THF soluble component is 0.8% by mass. The sample solution is measured on the following condition.

Apparatus: HLC8120 GPC (detector: RI)(made by Tosoh Corporation)

Column: 7 columns of Shodex KF-801, 802, 803, 804, 805, 806, and 807 (made by Showa Denko K.K.)

Eluent: tetrahydrofuran (THF)

Flow rate: 1.0 mL/min

Oven temperature: 40.0° C.

Amount of sample to be injected: 0.10 mL

The molecular weight of the sample to be measured is calculated using a molecular weight calibration curve created using a standard polystyrene resin (for example, trade names "TSK Standard Polystyrenes F-850, F-450, F-288, F-128, F-80, F-40, F-20, F-10, F-4, F-2, F-1, A-5000, A-2500, A-1000, and A-500," made by Tosoh Corporation).

<Measurement of Content of Structure A in Charge Controlling Resin>

The content (μmol/g) of the structure A represented by the formula (1) in the charge controlling resin is obtained by determining a hydroxyl value, and calculating the content (μmol/g) of the structure A in the polymer based on the amount of the hydroxyl group that the polymer has, the hydroxyl group being derived from the structure A.

The hydroxyl value is the amount in mg of potassium hydroxide needed to neutralize acetic acid bonded to a hydroxyl group when 1 g of the sample is acetylated. The hydroxyl value in the present invention is measured according to JIS K 0070-1992, and specifically according to the following procedure.

25.0 g of super grade acetic anhydride is placed in a 100 mL volumetric flask, and pyridine is added to provide a solution having a total volume of 100 mL. The solution is sufficiently shaken to obtain an acetylation reagent. The obtained acetylation reagent is stored in a brown bottle so as to avoid contact with moisture and carbon dioxide gas.

Titration is performed using a 1.0 mol/L potassium hydroxide ethyl alcohol solution (made by KISHIDA CHEMICAL Co., Ltd.). The factor of the potassium hydroxide ethyl alcohol solution can be determined using a potentiometric titrator (made by Kyoto Electronics Manufacturing Co., Ltd., potentiometric titrator AT-510). 100 mL of a 1.00 mol/L hydrochloric acid is placed in a 250 mL tall beaker, and titrated with the potassium hydroxide solution. The hydroxyl value is determined from the amount of the potassium hydroxide ethyl alcohol solution needed for neutralization. The 1.00 mol/L hydrochloric acid prepared according to JIS K 8001-1998 is used.

Below, the condition on the measurement of the hydroxyl value is shown.

Titrator: potentiometric titrator AT-510 (made by Kyoto Electronics Manufacturing Co., Ltd.)
Electrode: composite glass electrode double-junction type (made by Kyoto Electronics Manufacturing Co., Ltd.)
Control software for titrator: AT-WIN
Titration analyzing software: Tview
The titration parameters and control parameters during titration are set as follows.
Titration Parameters
Titration mode: blank titration
Titration method: total amount titration
Largest titration amount: 80 mL
Waiting time before titration: 30 seconds
Titration direction: automatic
Control Parameters
End point determining potential: 30 dE
End point determining potential value: 50 dE/dmL
Determination of end point detection: not set
Control rate mode: standard
Gain: 1
Data collecting potential: 4 mV
Data collecting titration amount: 0.5 mL
Main Test;

2.00 g of a crushed sample to be measured is precisely weighed and placed into a 200 mL round-bottomed flask, and exactly 5.00 mL of the acetylation reagent is added to this using a transfer pipette. At this time, if the sample is difficult to dissolve in the acetylation reagent, a small amount of super grade toluene is added to dissolve the sample.

A small funnel is placed on the neck of the flask, and the bottom of the flask is dipped by 1 cm in a glycerol bath at 97° C. and heated. At this time, in order to prevent the temperature of the neck of the flask from being increased by the heat from the bath, a cardboard having a round hole is preferably disposed on the bottom of the neck of the flask.

After 1 hour, the flask is taken out from the glycerol bath, and left as it is to be cooled. After cooling, 1.00 mL of water is added with the funnel, and the solution is shaken to hydrolyze acetic anhydride. Further, in order to completely hydrolyze acetic anhydride, the flask is again heated in the glycerol bath for 10 minutes. After cooling, the funnel and the wall of the flask are washed with 5.00 mL of ethyl alcohol.

The obtained sample is poured in a 250 mL tall beaker, and 100 mL of a mixed solution of toluene/ethanol (3:1) is added to dissolve the sample over 1 hour. Using the potentiometric titrator, the sample is titrated with the potassium hydroxide ethyl alcohol solution.

Blank Test;

The same operation is performed in the titration except that the sample is not used.

The obtained result is substituted into the following equation to calculate the hydroxyl value.

$$A=[\{(B-C)\times 28.05\times f\}/S]+D$$

wherein A: hydroxyl value (mgKOH/g), B: the amount of potassium hydroxide solution to be added (mL) in the blank test, C: the amount of potassium hydroxide solution to be added (mL) in the main test, f: the factor of the potassium hydroxide solution, S: sample (g), D: acid value of the resin (mgKOH/g).

<Measurement of Content of Structure B in Charge Controlling Resin>

An amount of a sulfur element (ppm) contained in the polymer is measured. From the amount of the sulfur element, the content (μmol/g) of the structure B represented by the formula (2) in the charge controlling resin is calculated. Specifically, the polymer is introduced into an automatic sample combustion apparatus (apparatus name: ion chromatography pre-treatment apparatus AQF-100 (specification of the apparatus: Auto Boat Controller ABC, an integrated type of AQF-100 and GA-100, made by DIA Instruments Co., Ltd.), and turned into combustion gas. The gas is absorbed by an absorbent solution ($H_2O_2$, 30 ppm aqueous solution). Next, using an ion chromatography (apparatus name: Ion Chromatograph ICS2000, column: IONPAC AS17, made by Dionex Corporation), the amount of $SO_4$ contained in the absorbent solution is measured. Thereby, the amount of the sulfur element (ppm) contained in the polymer is calculated. From the amount of the sulfur element (ppm) in the polymer, the content (μmol/g) of the structure B represented by the formula (2) in the polymer is calculated. The structure B can be identified by analysis using NMR described later.

<Measurement of Content of Structure B in Toner>

The amount of the sulfur element (ppm) contained in the toner is measured. From the amount of the sulfur element, the content (μmol/g) of the structure B in the toner is calculated. The measurement can be performed in the same manner as in the measurement of the amount of the sulfur element above.

<Measurement of Molar Ratio a/b of Structure A to Structure B in Toner>

The measurement of molar ratio a/b of the structure A to the structure B in the toner can be determined from the molar ratio a/b of the content (μmol/g) of the structure A calculated from the hydroxyl value in polymer to the content (μmol/g) of the structure B calculated from the amount of the sulfur element in the polymer.

<Measurement of Charge Controlling Resin and Acid Value of Resin>

The acid value is an amount in mg of potassium hydroxide needed to neutralize acids contained in 1 g of the sample. The acid value in the present invention is measured according to JIS K 0070-1992, and specifically according to the following procedure.

Titration is performed using a 0.1 mol/L potassium hydroxide ethyl alcohol solution (made by KISHIDA CHEMICAL Co., Ltd.). The factor of the potassium hydroxide ethyl alcohol solution can be determined using a potentiometric titrator (made by Kyoto Electronics Manufacturing Co., Ltd., a potentiometric titrator AT-510). 100 mL of 0.100 mol/L hydrochloric acid is placed in a 250 mL tall beaker, and titrated with the potassium hydroxide ethyl alcohol solution.

The acid value is determined from the amount of the potassium hydroxide ethyl alcohol solution needed for neutralization. The 0.100 mol/L hydrochloric acid prepared according to JIS K 8001-1998 is used.

Below, the condition on the measurement of the acid value is shown.

Titrator: potentiometric titrator AT-510 (made by Kyoto Electronics Manufacturing Co., Ltd.)

Electrode: composite glass electrode double-junction type (made by Kyoto Electronics Manufacturing Co., Ltd.)

Control software for titrator: AT-WIN

Titration analyzing software: Tview

The titration parameters and control parameters during titration are set as follows.

Titration Parameters

Titration mode: blank titration

Titration method: total amount titration

Largest titration amount: 20 mL

Waiting time before titration: 30 seconds

Titration direction: automatic

Control Parameters

End point determining potential: 30 dE

End point determining potential value: 50 dE/dmL

Determination of end point detection: not set

Control rate mode: standard

Gain: 1

Data collecting potential: 4 mV

Data collecting titration amount: 0.1 mL

Main Test;

0.100 g of the sample to be measured is precisely weighed and placed in a 250 mL tall beaker, and 150 mL of a mixed solution of toluene/ethanol (3:1) is added. The sample is dissolved over 1 hour. Using the potentiometric titrator, the mixed solution is titrated with the potassium hydroxide ethyl alcohol solution.

Blank Test;

The same operation as above is performed in the titration except that the sample is not used (namely, only the mixed solution of toluene/ethanol (3:1) is used).

The obtained result is substituted into the following equation to calculate the acid value.

$$A=[(C-B)\times f\times 5.611]/S$$

(wherein A: acid value (mgKOH/g), B: the amount of the potassium hydroxide solution to be added (mL) in the blank test, C: the amount of the potassium hydroxide solution to be added (mL) in the main test, f: the factor of the potassium hydroxide solution, S: sample (g).)

<Analysis of Structures of Charge Controlling Resin>

The structures of the polymer having the structure B, the polymer having the structure A, and the polymerizable monomer can be determined using a nuclear magnetic resonance apparatus ($^{1}$H-NMR, $^{13}$C-NMR) and an FT-IR spectrum. Hereinafter, the apparatus to be used will be described.

(i) $^{1}$H-NMR, $^{13}$C-NMR made by JEOL, Ltd., FT-NMR JNM-EX400 (solvent to be used, chloroform-dl)

(ii) FT-IR spectrometer made by Thermo Fisher Scientific Inc. AVATAR360 FT-IR

<Glass Transition Temperature of Toner>

The glass transition temperature of the toner according to the present invention is measured using a differential scanning calorimeter (DSC measurement apparatus).

Using a differential scanning calorimeter "Q1000" (made by TA Instruments-Waters LLC) as the differential scanning calorimeter, measurement is performed according to ASTM D3418-82. 2 to 5 mg, and preferably 3 mg of the sample to be measured is precisely weighed. The sample is put into an aluminum pan, and an empty aluminum pan is used as a reference. The sample is kept in equilibrium at 20° C. for 5 minutes. Then, measurement is performed in the measurement range of 20 to 140° C. at a temperature raising rate of 1° C./min and modulation of 1.0° C./min. In the present invention, the glass transition temperature can be determined by a midpoint method.

<Weight Average Particle Size (D4) and Number Average Particle Size (D1) of Toner>

The weight average particle size (D4) and the number average particle size (D1) of the toner are calculated as follows. As the measurement apparatus, an accurate particle size distribution measurement apparatus "Coulter Counter Multisizer 3" (Registered Trademark, made by Beckman Coulter, Inc.) having a 100 μm aperture tube is used, in which an aperture electric resistance method is used. The setting of the measurement condition and analysis of the measured data are performed using the dedicated software "Beckman Coulter Multisizer 3 Version 3.51" (made by Beckman Coulter, Inc.). The measurement is performed at 25,000 effective measuring channels.

An electrolytic aqueous solution that can be used for the measurement is those obtained by dissolving super grade sodium chloride in ion exchange water such that the concentration is 1% by mass, for example, "ISOTON II" (made by Beckman Coulter, Inc.).

Before the measurement and analysis are performed, the dedicated software is set as follows. In a "change standard measuring method (SOM)" screen in the dedicated software, the total count number in the control mode is set at 50000 particles, the number of measurement is set at 1, and the Kd value is set at a value obtained using a "standard particle 10.0 μm" (made by Beckman Coulter, Inc.). A "threshold/noise level measuring button" is pressed to automatically set the threshold and the noise level. The current is set at 1600 μA, and the gain is set at 2. The electrolyte solution is set at ISOTON II, and "flush aperture tube after measurement" is checked. In a "set conversion from pulse to particle size" screen in the dedicated software, the bin interval is set at a logarithmic particle size, the particle size bin is set at 256 particle size bins, and the particle size range is set from 2 μm to 60 μm.

A specific measurement method is as follows.

(1) 200 mL of the electrolytic aqueous solution is placed in a 250 mL round-bottomed glass beaker only for Multisizer 3, and set on a sample stand. The electrolytic aqueous solution is stirred by a stirring rod counterclockwise at 24 rotations/sec. Dirt and bubbles within the aperture tube are removed by a function to "flush aperture" in the dedicated software.

(2) 30 mL of the electrolytic aqueous solution is placed in a 100 mL flat-bottomed glass beaker. To the electrolytic aqueous solution, 0.3 mL of a diluted solution as a dispersant is added, the diluted solution being obtained by diluting "CONTAMINONN" (10% by mass aqueous solution of a neutral detergent for washing a precise measurement apparatus having a pH of 7 and including a nonionic surfactant, an anionic surfactant, and an organic builder, made by Wako Pure Chemical Industries, Ltd.) with ion exchange water 3 times in mass.

(3) An ultrasonic disperser "Ultrasonic Dispension System Tetora 150" (made by Nikkaki-Bios Co., Ltd.) having an electrical output of 120 W is prepared, in which two oscillators having an oscillation frequency of 50 kHz are incorporated with one phase thereof being shifted 180° from the other. 3.3 L of ion exchange water is placed in a water bath of the ultrasonic disperser, and 2 mL of CONTAMINONN is added to the water bath.

(4) The beaker in (2) is set in a beaker fixing hole of the ultrasonic disperser, and the ultrasonic disperser is operated. The vertical position of the beaker is adjusted such that the resonant state at the solution level of the electrolytic aqueous solution in the beaker is the maximum.

(5) While the electrolytic aqueous solution in the beaker of (4) is irradiated with an ultrasonic wave, 10 mg of the toner is added to the electrolytic aqueous solution little by little, and dispersed. Further, the ultrasonic dispersing treatment is continued for 60 seconds. In the ultrasonic dispersion, the temperature of water in the water bath is properly adjusted such that the temperature is not less than 10° C. and not more than 40° C.

(6) Using a pipette, the electrolyte aqueous solution sample in which the toner is dispersed in (5) is dropped in the round-bottomed beaker in (1) set in the sample stand, and adjusted such that the measurement concentration is 5%. The measurement is performed until the number of particles to be measured reaches 50000.

(7) The data obtained by the measurement is analyzed by the dedicated software attached to the apparatus, the weight average particle size (D4), the number average particle size (D1), the volume-based median particle size, and the number-based median particle size are calculated. The weight average particle size (D4) is provided as the "average size" in an "analysis/volume statistical value (arithmetic average)" screen when graph/% by volume is set using the dedicated software, and the "median size" is a volume-based median particle size (Dv50). The number average particle size (D1) is provided as an "average size" in an "analysis/number statistical value (arithmetic average)" screen when graph/% by number is set using the dedicated software, and the "median size" is a number-based median particle size (Dn50).

EXAMPLES

Hereinafter, using Examples, the present invention will be specifically described, but the present invention will not be limited to these Examples. "Parts" mean "parts by mass."

Production Examples of Monomer Represented by Formula (5):

<Production Example of Monomer 5A>

(Step 1)

While 100 g of 2,5-dihydroxybenzoic acid and 1441 g of 80% sulfuric acid are heated to 50° C., these are mixed. 144 g of tert-butyl alcohol is added to the mixed solution, and stirred at 50° C. for 30 minutes. Next, the operation is performed 3 times in which 144 g of tert-butyl alcohol is added to the mixed solution, and stirred at 50° C. for 30 minutes. The reaction solution is cooled to room temperature. The reaction solution is gradually poured into 1.00 kg of ice water, and a precipitate is filtered. The precipitate is washed with water, and further washed with hexane. The precipitate obtained here is dissolved in 200 mL of methanol, and again precipitated using 3.60 L of water. After filtration, the obtained product is dried at 80° C. to obtain 74.9 g of a salicylic acid intermediate product represented by the following formula (8).

Formula (8)

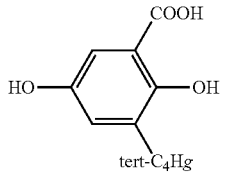

(Step 2)

25.0 g of the salicylic acid intermediate product is dissolved in 150 mL of methanol. 36.9 g of potassium carbonate is added to the solution, and the solution is heated to 65° C. A solution is prepared by mixing and dissolving 18.7 g of 4-(chloromethyl)styrene in 100 mL of methanol, and dropped into the solution having the salicylic acid intermediate product dissolved therein. A reaction is made at 65° C. for 3 hours. The obtained reaction solution is cooled, and filtered. Methanol in the filtrate is removed under reduced pressure to obtain a precipitate. The precipitate is dispersed in 1.5 L of water at pH=2. Ethyl acetate is added, and the precipitate is extracted. Then, the precipitate is washed with water, and dried with magnesium sulfate. Ethyl acetate is removed under reduced pressure to obtain a precipitate. The precipitate is washed with hexane, and recrystallized with toluene/ethyl acetate to obtain 20.1 g of vinyl monomer 5A represented by the formula (5A) below.

Formula (5A)

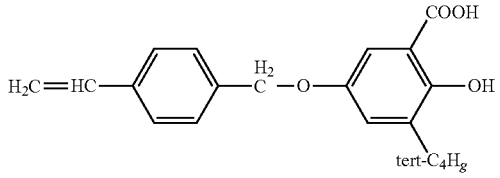

<Production Example of Monomer 5B>

100.0 g of 2,5-dihydroxybenzoic acid is dissolved in 2 L of methanol, 88.3 g of potassium carbonate is added, and the solution is heated to 67° C. 102.0 g of 4-(chloromethyl) styrene is dropped into the solution over 22 minutes, and a reaction is made at 67° C. for 12 hours. The obtained reaction solution is cooled, and methanol is removed under reduced pressure. The residue is washed with hexane. The residue is dissolved in methanol, and the solution is dropped into water to reprecipitate the residue. The precipitate is filtered. The reprecipitation operation is repeated twice, and the residue is dried at 80° C. to obtain vinyl monomer 5B represented by the formula (5B) below.

Formula (5B)

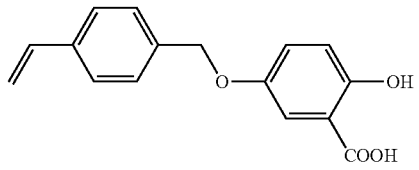

<Synthesis Example of Monomer 5C>

Vinyl monomer 5C represented by the formula (5C) below is obtained by the same method as that in the synthesis of vinyl monomer 5A (Step 2) except that the salicylic acid derivative product represented by the formula (5A) is replaced by 18 g of 2,6-dihydroxybenzoic acid.

Formula (5C)

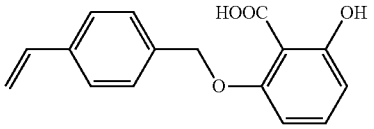

<Production Example of Monomer Represented by Formula (6)>

788 g of 2-amino-5-methoxybenzenesulfonic acid, 642 g of triethylamine, and 4 L of tetrahydrofuran are placed in a reaction container having a stirrer, a thermometer, and a nitrogen introducing pipe attached thereto, and 352 g of methacrylic chloride is dropped at a temperature of not more than 5° C. over 15 minutes. While the temperature is kept at not more than 5° C., the solution is stirred for 6 hours. While the temperature is kept at not more than 5° C., 800 mL of concentrated sulfuric acid and 12.8 L of water are added to the reaction mixture. The solution is separated. The organic layer is washed with 6.4 L of 2% hydrochloric acid, and then, washed with 6.4 L of water 3 times. The obtained solution is condensed under reduced pressure to obtain crystals. The obtained crystals are placed in a reaction container having a stirrer, a capacitor, a thermometer, and a nitrogen introducing pipe attached thereto. Further, 1680 g of trimethyl orthoformate and 1.50 g of p-benzoquinone are placed in the reaction container to make a reaction at 80° C. for 10 hours. The reaction mixture is cooled, and condensed under reduced pressure. The precipitated crystals are filtered out, added to 5 L of water, and dispersed to be washed. The crystals are filtered, and washed with 2.5 L of water twice. The obtained crystals are dried at 30° C. with a fair wind, and refined by column chromatography (5 kg of silica gel, mobile phase hexane/ethyl acetate=1/1) to obtain 383 g of monomer 6A represented by the formula (6A).

Formula (6A)

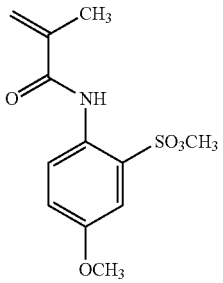

<Synthesis Example of Monomer 6B>

856 g of 2-nitrobenzenesulfonyl chloride and 7 L of methanol are placed in a reaction container having a stirrer, a thermometer, and a nitrogen introducing pipe attached thereto, and a mixed solution of 745 g of 28% sodium methylate and 600 mL of methanol is dropped at a temperature of not more than 10° C. over 45 minutes. Subsequently, the solution is stirred for 50 minutes while the temperature is kept at 10° C. 1.6 kg of 0.1 mol/L hydrochloric acid is added to the reaction mixture to make the reaction solution acidic, and 3 L of water is further added to precipitate crystals. The crystals are filtered out, and washed with 2 L of water. Then, the crystals are dried under reduced pressure at 30° C. for 10 hours to obtain 702 g of 2-nitrobenzenesulfonic acid methyl ester.

688 g of 2-nitrobenzenesulfonic acid methyl ester, 4.7 L of acetic acid, and 2.18 kg of $SnCl.H_2O$ are placed in a reaction container having a stirrer, a thermometer, and a nitrogen introducing pipe attached thereto, and cooled to a temperature of not more than 10° C. Hydrochloric acid gas is blown into the reaction mixture under stirring for 4 hours. Next, the reaction mixture is stirred at not more than 10° C. for 10 hours. 8.4 L of chloroform is added to the reaction mixture, and neutralized by a 20% NaOH aqueous solution while the temperature is kept at not more than 10° C. Further, 56 L of water is added, and the reaction mixture is separated. An aqueous phase is extracted by 4 L of chloroform, washed with a chloroform layer with 4 L of water twice, and separated. The separated product is dried by anhydrous magnesium sulfate, and filtered to obtain a chloroform solution of 2-aminobenzenesulfonic acid methyl ester. The obtained solution and 950 g of diethylaniline are placed in a reaction container having a stirrer, a thermometer, and a nitrogen introducing pipe attached thereto, and 287 g of acrylic acid chloride is dropped at a temperature of not more than 5° C. over 15 minutes. The temperature is kept at not more than 5° C., and the solution is stirred for 6 hours. 800 mL of concentrated hydrochloric acid and 12.8 L of water are added to the reaction mixture, and the reaction mixture is separated. An organic layer is washed with 6.4 L of 2% hydrochloric acid, 6.4 L of water, 6.4 L of a 3% sodium hydrogen carbonate aqueous solution, and 6.4 L of water in this order. The organic layer is dried with anhydrous magnesium sulfate, filtered, and dried under reduced pressure at 30° C. to obtain 796 g of crystals. The crystals are refined by column chromatography (5 kg of silica gel, mobile phase of hexane/ethyl acetate=2/1) to obtain 406 g of Monomer 6B represented by the formula (6B):

Formula (6B)

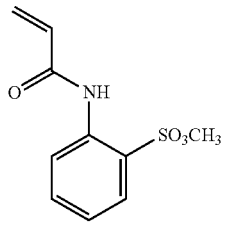

<Synthesis Example of Monomer 6C>

352 g of Monomer 6C represented by the formula (6C) is obtained by the same method except that 726 g of p-toluidine-2-sulfonic acid is used instead of 2-amino-5-methoxybenzenesulfonic acid in production of Monomer 6A:

Formula (6C)

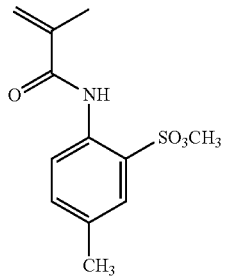

<Synthesis Example of Monomer 6D>

1500 g of 2-acrylamide-2-methylpropanesulfonic acid, 2060 g of trimethyl orthoformate, and 1.5 g of p-benzoquinone are placed in a reaction container having a stirrer, a capacitor, a thermometer, and a nitrogen introducing pipe attached thereto, and reacted at 80° C. for 5 hours. The reaction mixture is cooled, and condensed under reduced pressure. The precipitated crystals are filtered out, added to 5 L of water, dispersed to be washed, filtered, and washed with 2.5 L of water twice. The obtained crystals are dried at 30° C. with a fair wind, dispersed to be washed with 4 L of hexane, and filtered out. The obtained crystals are dried under reduced pressure at 30° C. to obtain 1063 g of Monomer 6D represented by the formula (6D):

Formula (6D)

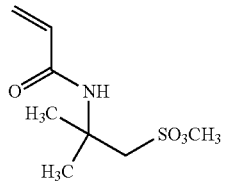

<Monomer 6E>

As Monomer 6E, 2-acrylamide-2-methylpropanesulfonic acid represented by the formula (6E) is used:

Formula (6E)

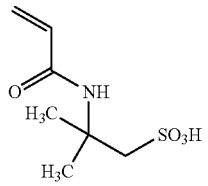

<Monomer 6F>

As Monomer 6F, 2-methacrylamide-5-methoxybenzenesulfonic acid represented by the formula (6F) is used:

Formula (6F)

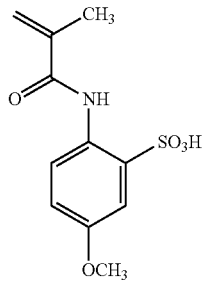

<Monomer 6G>

As Monomer 6G, 2-acrylamidebenzenesulfonic acid represented by the formula (6G) is used:

Formula (6G)

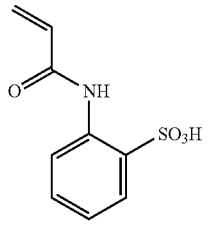

<Synthesis Example of Monomer 8A for Comparative Example>

Monomer 8A represented by the formula (8A) is produced by the method described in Japanese Patent Application Laid-Open No. S63-270060, and Journal of Polymer Science: Polymer Chemistry Edition 18,2755 (1980).

Formula (8A)

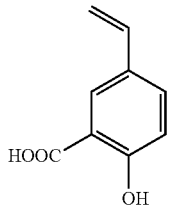

<Synthesis Example of Monomer 8B for Comparative Example>

Monomer 8B represented by the formula (8B) is produced by the method described in Japanese Patent Application Laid-Open No. S62-187429.

Formula (8B)

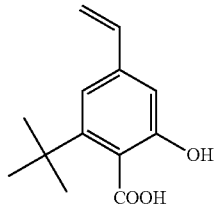

<Production Example of Polymer 1>

60.00 parts of toluene is placed in a reaction container having a stirrer, a capacitor, a thermometer, and a nitrogen introducing pipe attached thereto, and refluxed under a nitrogen gas flow.

Next, monomers and solvents below are mixed to prepare a monomer mixed solution.

<Monomer Composition, Mixing Ratio>

| | |
|---|---|
| Monomer 5A | 10.0 parts |
| Monomer 6E | 6.0 parts |
| Styrene | 84.0 parts |
| Toluene | 60.0 parts |

6.6 parts of t-butyl peroxyisopropyl monocarbonate (75% hydrocarbon solvent diluted product) as a polymerization initiator is further added to the monomer mixed solution, and the monomer mixed solution is dropped to the reaction container over 30 minutes. The monomer mixed solution is stirred at 60° C. for 8 hours, and cooled to room temperature. The obtained polymer containing composition is dropped to a mixed solution of 1400 parts of methanol and 10 parts of acetone under stirring in 10 minutes to precipitate and crystallize the resin composition. The obtained resin composition is filtered out, and washed with 200 parts of methanol twice. The obtained resin powder is dried under reduced pressure at 60° C. for 10 hours to obtain Polymer 1.

<Production Examples of Polymers 2 to 13 and 16 to 18>

Polymer 2 to 13 and 16 to 18 are obtained by the same method as that in Production Example of Polymer 1 except that the monomer composition, the mixing ratio, and the number of parts of t-butyl peroxyisopropyl monocarbonate as the polymerization initiator are changed as shown in Table 2. The composition ratios and molecular weights of Polymers 2 to 13 and 16 to 18 are shown in Table 3.

TABLE 2

| | | Monomer formula (5) | | Monomer formula (6) | | Vinyl polymer 1 | | Vinyl polymer 2 | | t-Butyl |
|---|---|---|---|---|---|---|---|---|---|---|
| | Polymer | Structure | Amount to be added (parts) | Structure | Amount to be added (parts) | Structure | Amount to be added (parts) | Structure | Amount to be added (parts) | peroxyisopropyl monocarbonate Amount to be added (parts) |
| Production Example 1 | Polymer1 | 5A | 10.0 | 6E | 6.0 | Styrene | 84.0 | | | 6.6 |
| Production Example 2 | Polymer2 | 5A | 4.0 | 6E | 25.0 | Styrene | 71.0 | | | 6.6 |
| Production Example 3 | Polymer3 | 5A | 2.0 | 6E | 25.0 | Styrene | 73.0 | | | 6.6 |
| Production Example 4 | Polymer4 | 5A | 30.0 | 6E | 2.0 | Styrene | 60.0 | Butyl acrylate | 8.0 | 6.6 |
| Production Example 5 | Polymer5 | 5A | 30.0 | 6E | 1.0 | Styrene | 60.0 | 2-Ethylhexyl acrylate | 9.0 | 6.6 |
| Production Example 6 | Polymer6 | 5A | 30.0 | 6A | 10.0 | Styrene | 60.0 | | | 6.6 |
| Production Example 7 | Polymer7 | 5A | 6.0 | 6B | 10.0 | Styrene | 84.0 | | | 6.6 |
| Production Example 8 | Polymer8 | 5A | 20.0 | 6F | 10.0 | Styrene | 70.0 | | | 8.8 |
| Production Example 9 | Polymer9 | 5B | 10.0 | 6F | 10.0 | Styrene | 80.0 | | | 3.3 |
| Production Example 10 | Polymer10 | 5B | 10.0 | 6E | 5.0 | Styrene | 75.0 | Butyl acrylate | 10.0 | 6.6 |
| Production Example 11 | Polymer11 | 5B | 5.0 | 6D | 20.0 | Styrene | 75.0 | | | 6.6 |
| Production Example 12 | Polymer12 | 5C | 2.0 | 6G | 25.0 | Styrene | 73.0 | | | 6.6 |
| Production Example 13 | Polymer13 | 5C | 2.0 | 6C | 20.0 | Styrene | 78.0 | | | 6.6 |
| Production Example 16 | Polymer16 | 8A | 14.0 | | | Styrene | 86.0 | | | 6.6 |
| Production Example 17 | Polymer17 | 8B | 28.0 | | | Styrene | 62.0 | Butyl acrylate | 10.0 | 6.6 |
| Production Example 18 | Polymer18 | | | 6E | 6.0 | Styrene | 94.0 | | | 6.6 |

<Production Example of Polymer 14>

95.0 parts of propylene glycol, 103.8 parts of terephthalic acid, 5 parts of trimellitic acid, 14.0 parts of adipic acid, 24.0 parts of maleic anhydride, and 2.0 parts of tetrastearyl titanate as a condensation catalyst are placed in a reaction tank having a cooling pipe, a stirrer, a thermometer, and a nitrogen introducing pipe attached thereto, and reacted for 6 hours while generated water is removed by distillation at 230° C. under a nitrogen gas flow. Next, a reaction is made under a reduced pressure of 5 to 20 mmHg for 8 hours to obtain Unsaturated Polyester Resin 1. Unsaturated Polyester Resin 1 has physical properties as follows: an acid value of 34.0 mgKOH/g, a hydroxyl value of 8.5 mgKOH/g, Mn of 2700, and Mw of 5100.

On the other hand, 200 parts of toluene and 100 parts of the Unsaturated Polyester Resin 1 are placed in a reaction tank having a cooling pipe, a stirrer, a thermometer, and a nitrogen introducing pipe attached thereto, and stirred under a nitrogen gas flow at 50° C.

| | |
|---|---|
| Monomer 5A | 10.0 parts |
| Monomer 6E | 16.0 parts |

-continued

| | |
|---|---|
| Styrene | 40.0 parts |
| Toluene | 50.0 parts |

3.50 parts of t-butyl peroxyisopropyl monocarbonate (75% hydrocarbon solvent diluted product) as a polymerization initiator is further added to the monomer mixed solution, and the monomer mixed solution is dropped to the reaction container over 30 minutes. The monomer mixed solution is stirred at 110° C. for 3 hours, and cooled to room temperature. The obtained polymer containing composition is dropped to a mixed solution of 2800 parts of methanol and 20 parts of acetone under stirring in 10 minutes to precipitate and crystallize the resin composition. The obtained resin composition is filtered out, and washed with 300 parts of methanol twice. The obtained resin powder is dried under reduced pressure at 60° C. for 10 hours to obtain Polymer 14. Polymer 14 has a hydroxyl value of 25.3 mgKOH/g. It is found from the difference between the hydroxyl value of Polymer 14 and that of Unsaturated Polyester Resin 1, i.e., 16.8 mgKOH/g that 299.4 μmol/g of the structure A represented by the formula (9A) is contained. From the measurement of the amount of a sulfur element in Polymer 14, it turns out that 0.875% by mass of the sulfur element is contained. Accordingly, it is found that 272.9 μmol/g of the structure B represented by the formula (10E) is contained. Moreover, Polymer 14 has an Mn of 3500 and an Mw of 7200. The composition ratio and molecular weight of the obtained Polymer 14 are shown in Table 3.

Formula (9A)

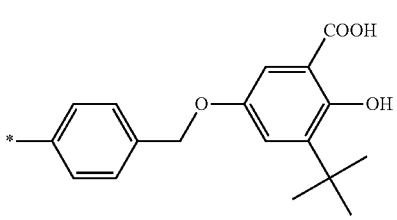

Formula (10E)

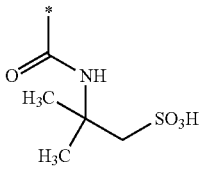

<Production Example of Polymer 15>

91.0 parts of bisphenol A propylene oxide 2 mol adduct, 103.8 parts of terephthalic acid, 5.0 parts of trimellitic anhydride, 8.0 parts of adipic acid, and 2.0 parts of tetrastearyl titanate as a condensation catalyst are placed in a reaction tank having a cooling pipe, a stirrer, a thermometer, and a nitrogen introducing pipe attached thereto, and reacted for 5 hours while generated water is removed by distillation at 230° C. under a nitrogen gas flow. Next, a reaction is made under a reduced pressure of 5 to 20 mmHg for 8 hours to obtain Polyester Resin 3. Polyester Resin 3 has physical properties as follows: an acid value of 46.5 mgKOH/g, a hydroxyl value of 7.8 mgKOH/g, Mn of 4700, and Mw of 8900.

Next, 100 parts of Polyester Resin 3 and 2 parts of p-toluidine-2-sulfonic acid are placed in a reaction tank having a cooling pipe, a stirrer, a thermometer, and a nitrogen introducing pipe attached thereto, and 380 parts of pyridine is added. The mixture is stirred, and 135 parts of triphenyl phosphite is added. The mixture is heated at 120° C. for 6 hours. After the reaction is completed, the obtained product is reprecipitated in 500 parts of ethanol, and recovered. Next, the product is washed using 200 parts of 1 mol/L hydrochloric acid twice, further washed with 200 parts of water twice, and dried under reduced pressure to obtain Polyester Resin 4. From the measurement of the amount of a sulfur element, it turns out that the obtained Polyester Resin 4 contains 0.210% by mass of the sulfur element. Accordingly, it is found that 65.5 μmol/g of the structure B represented by the formula (10G) is contained.

Formula (10G)

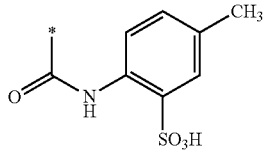

Next, 100 parts of Polyester Resin 4 and 20 parts of the compound represented by the formula (11) are placed in a reaction tank having a cooling pipe, a stirrer, a thermometer, and a nitrogen introducing pipe attached thereto, and 380 parts of pyridine is added. The mixture is stirred, and 135 parts of triphenyl phosphite is added. The mixture is heated at 120° C. for 6 hours. After the reaction is completed, the obtained product is reprecipitated in 500 parts of ethanol, and recovered. Next, the product is washed using 200 parts of 1 mol/L hydrochloric acid twice, further washed with 200 parts of water twice, and dried under reduced pressure to obtain Polymer 15. Polymer 15 has a hydroxyl value of 59.9 mgKOH/g. From the difference between the hydroxyl value of Polymer 15 and that of Saturated Polyester Resin 3, the hydroxyl value of the structure A represented by the formula (9B) is 52.1 mgKOH/g. Namely, it is found that 928.4 μmol/g of the structure A represented by the formula (9B) is contained. From the measurement of the amount of a sulfur element in Polymer 15, it turns out that 0.189% by mass of the sulfur element is contained. Accordingly, it is found that 58.9 μmol/g of the structure B represented by the formula (10G) is contained. Moreover, Polymer 15 has an Mn of 4900 and an Mw of 9100. The composition ratio and molecular weight of the obtained Polymer 15 are shown in Table 3.

Formula (11)

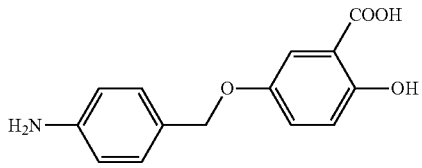

Formula (9B)

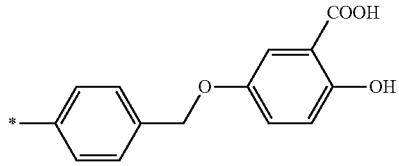

TABLE 3

| | | Structure A in polymer | | | Structure B in polymer | | | | | |
|---|---|---|---|---|---|---|---|---|---|---|
| | Polymer | Structure | Hydroxyl value (mgKOH/g) | Content (μmol/g) | Structure | Amount of sulfur (% by mass) | Content (μmol/g) | Molecular weight Mw | Mw/Mn | Main chain | |
| Production Example 1 | Polymer 1 | 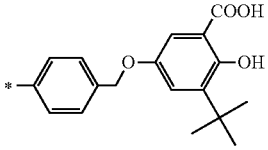 | 17.2 | 304.7 | 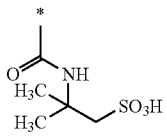 | 0.913 | 284.7 | 12500 | 2.3 | Vinyl | Polymer for Example |
| Production Example 2 | Polymer 2 | 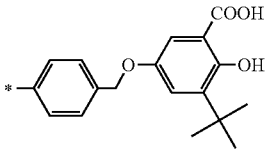 | 6.9 | 123.0 | 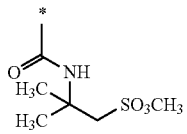 | 3.613 | 1126.8 | 12900 | 2.5 | Vinyl | Polymer for Example |
| Production Example 3 | Polymer 3 | 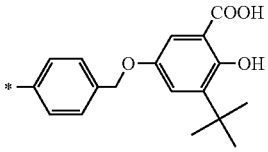 | 3.4 | 60.6 | 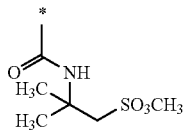 | 3.602 | 1123.3 | 12800 | 2.4 | Vinyl | Polymer of Example |
| Production Example 4 | Polymer 4 | 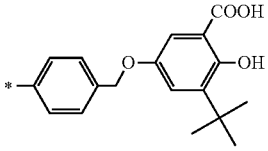 | 51.4 | 915.9 | 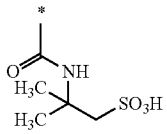 | 0.310 | 96.7 | 11500 | 24 | Vinyl | Polymer for Example |
| Production Example 5 | Polymer 5 | 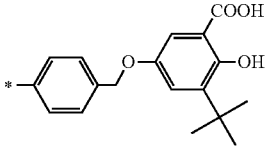 | 51.3 | 914.2 | 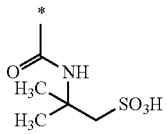 | 0.139 | 43.3 | 12100 | 2.3 | Vinyl | Polymer for Example |
| Production Example 6 | Polymer 6 | 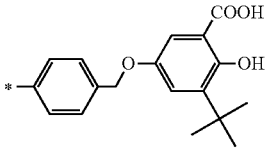 | 51.4 | 915.9 | 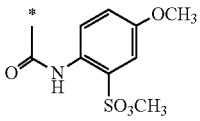 | 1.105 | 344.6 | 12200 | 2.3 | Vinyl | Polymer for Example |
| Production Example 7 | Polymer 7 | 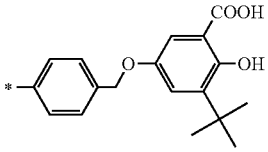 | 10.2 | 181.8 | 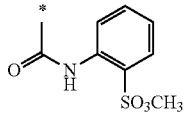 | 1.295 | 403.9 | 13100 | 2.3 | Vinyl | Polymer for Example |
| Production Example 8 | Polymer 8 | 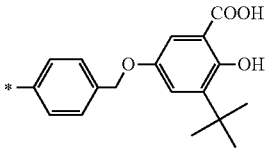 | 34.2 | 609.4 | 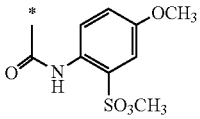 | 1.172 | 365.5 | 7100 | 2.9 | Vinyl | Polymer for Example |

TABLE 3-continued

| | | Structure A in polymer | | | Structure B in polymer | | | | | | |
|---|---|---|---|---|---|---|---|---|---|---|---|
| | Polymer | Structure | Hydroxyl value (mgKOH/g) | Content (μmol/g) | Structure | Amount of sulfur (% by mass) | Content (μmol/g) | Molecular weight Mw | Mw/Mn | Main chain | |
| Production Example 9 | Polymer 9 | 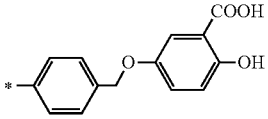 | 20.6 | 367.1 | 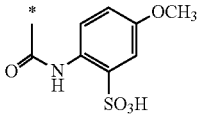 | 1.158 | 361.1 | 24100 | 2.4 | Vinyl | Polymer for Example |
| Production Example 10 | Polymer 10 | 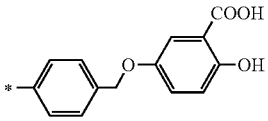 | 20.5 | 365.3 | 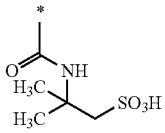 | 0.750 | 233.9 | 13100 | 2.3 | Vinyl | Polymer for Example |
| Production Example 11 | Polymer 11 | 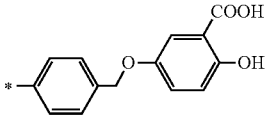 | 8.2 | 146.1 | 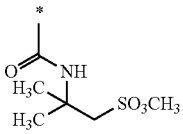 | 2.879 | 897.9 | 13500 | 2.4 | Vinyl | Polymer for Example |
| Production Example 12 | Polymer 12 | 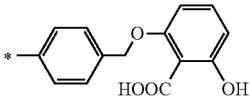 | 4.1 | 73.1 | 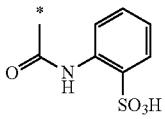 | 2.959 | 922.8 | 12500 | 2.4 | Vinyl | Polymer for Example |
| Production Example 13 | Polymer 13 | 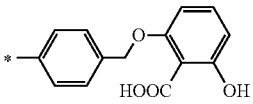 | 4.1 | 73.1 | 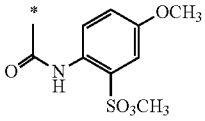 | 2.864 | 893.2 | 12000 | 2.4 | Vinyl | Polymer for Example |
| Production Example 14 | Polymer 14 | 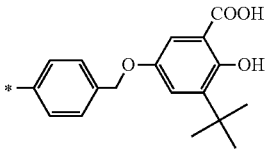 | 16.8 | 299.4 | 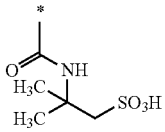 | 0.875 | 272.9 | 7200 | 2.1 | Polyester | Polymer for Example |
| Production Example 15 | Polymer 15 | 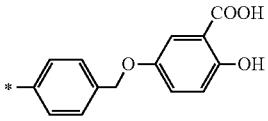 | 52.1 | 928.4 | 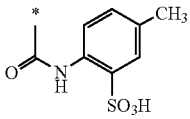 | 0.189 | 58.9 | 9100 | 1.9 | Polyester | Polymer for Example |
| Production Example 16 | Polymer 16 | 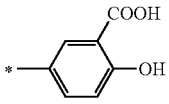 | 34.0 | 605.9 | — | — | — | 11500 | 2.3 | Vinyl | Polymer for Comparative Example |
| Production Example 17 | Polymer 17 | 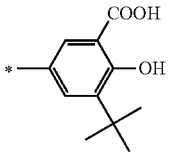 | 25.3 | 450.8 | — | — | — | 12200 | 2.3 | Vinyl | Polymer for Comparative Example |

TABLE 3-continued

| | Structure A in polymer | | | | Structure B in polymer | | | | | | |
|---|---|---|---|---|---|---|---|---|---|---|---|
| | Poly-mer | Structure | Hydro-xyl value (mgKOH/g) | Con-tent (μmol/g) | Structure | A-mount of sulfur (% by mass) | Content (μmol/g) | Molecular weight Mw | Mw/Mn | Main chain | |
| Pro-duc-tion Exam-ple 18 | Poly-mer 18 | — | — | — | 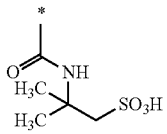 | 0.910 | 283.8 | 12000 | 2.3 | Vinyl | Poly-mer for Comp-arative Exam-ple |

Example 1

Production Example of Toner: Production of Pigment Dispersed Paste

<Ratio to be Added>

| | |
|---|---|
| Styrene | 80.0 parts |
| C.I. Pigment Blue 15:3 | 14.0 parts |

The materials above are sufficiently premixed in a container. The premix is dispersed by a bead mill for 5 hours while the temperature is kept at not more than 20° C., to produce a pigment dispersed paste.

Production of Toner Particles:

390 parts of a 0.1 mol/L-$Na_3PO_4$ aqueous solution is placed in 1150 parts of ion exchange water, and the solution is heated to 60° C. Using a Cleamix (made by M Technique Co., Ltd.), the solution is stirred at 11000 rpm. 58 parts of a 1.0 mol/L-$CaCl_2$ aqueous solution is added to the solution to obtain a dispersion liquid containing $Ca_3(PO_4)_4$.

<Ratio to be Added>

| | |
|---|---|
| pigment dispersed paste above | 38.0 parts |
| Styrene | 34.0 parts |
| n-Butylacrylate | 15.0 parts |
| Paraffin wax (HNP-7: made by NIPPON SEIRO CO., LTD.) | 8.00 parts |
| Saturated polyester resin (terephthalic acid-propylene oxide modified bisphenol A copolymer, acid value of 11 mgKOH/g, Mw: 15500) | 5.00 parts |
| Polymer 1 above | 0.500 parts |

The materials are heated to 60° C., molten, and dispersed to prepare a monomer mixture. Further, while the temperature is kept at 60° C., 5.00 parts of 2,2-azobis(2,4-dimethylvaleronitrile) as a polymerization initiator is added and dissolved to prepare a monomer composition.

The monomer composition is added to the dispersion medium. Using a Cleamix, stirring is performed at 60° C. in a nitrogen atmosphere at 10000 rpm for 20 minutes to granulate the monomer composition. Then, while stirring is performed with a paddle stirring blade, a reaction is made at 60° C. for 5 hours. Further, stirring is performed at 80° C. for 5 hours to complete polymerization. The obtained product is cooled to room temperature. Then, hydrochloric acid is added to the product to dissolve $Ca_3(PO_4)_2$, followed by filtration, washing with water, and drying. Thereby, toner particles are obtained. Further, the obtained toner particles are classified to sort particles having a particle size of not less than 2 μm and less than 10 μm. Thus, Toner Particles 1 are prepared.

Production of Toner 100 parts of Toner Particles 1 obtained are surface treated with hexamethyldisilazane. 1 part of hydrophobic silica fine powder treated with silicone oil is mixed with and externally added to Toner Particles 1 by a Henschel mixer (made by Mitsui Miike Kakoki K.K.), primary particles of the hydrophobic silica fine powder having a number average particle size of 9 nm and the BET specific surface area of 180 $m^2/g$. Thus, Toner 1 is obtained.

Examples 2 to 9 and 12 to 19

Production is performed in the same manner as in Example 1 except that the kind and parts of the polymer in Example 1 are changed as shown in Table 4. Thus, Toners 2 to 9 and 12 to 19 are obtained.

Example 10

Production of Pigment Dispersed Paste (Ratio to be Added)

| | |
|---|---|
| Styrene | 80.0 parts |
| Carbon black | 14.0 parts |

The materials are sufficiently premixed in a container. While the temperature is kept at not more than 20° C., the premix is dispersed by a bead mill for 4 hours to produce a pigment dispersed paste.

Production of Toner Particles 350 parts of a 0.1 mol/L-$Na_3PO_4$ aqueous solution is placed in 1200 parts of ion exchange water, and the solution is heated to 60° C. Then, using a Cleamix (made by M Technique Co., Ltd.), the solution is stirred at 11,000 rpm. 52 parts of a 1.0 mol/L-$CaCl_2$ aqueous solution is added to the solution to obtain a dispersion medium containing $Ca_2(PO_4)_2$.

| | |
|---|---|
| Pigment dispersed paste above | 38.0 parts |
| Styrene | 30.0 parts |
| n-Butylacrylate | 17.0 parts |
| Ester wax | 10.0 parts |

(principal component $C_{19}H_{39}COOC_{20}H_{41}$, melting point of 68.6° C.)

Saturated polyester resin 5.00 parts (terephthalic acid-propylene oxide modified bisphenol A copolymer, acid value of 11 mgKOH/g, Mw: 14800)

Polymer 6 above 0.500 parts

The materials are heated to 60° C., and dissolved and dispersed to prepare a monomer mixture. Further, while the temperature is kept at 60° C., 5.00 parts of 2,2'-azobis(2,4-dimethylvaleronitrile) as a polymerization initiator is added and dissolved to prepare a monomer composition.

The monomer composition is added to the dispersion medium. Using a Cleamix, stirring is performed at 60° C. in a nitrogen atmosphere at 10000 rpm for 20 minutes to granulate the monomer composition. Then, while stirring is performed with a paddle stirring blade, a reaction is made at 60° C. for 5 hours. Further, stirring is performed at 80° C. for 5 hours to complete polymerization. The obtained product is cooled to room temperature. Then, hydrochloric acid is added to the product to dissolve $Ca_2(PO_4)_2$, followed by filtration, washing with water, and drying. Thereby, toner particles are obtained. Further, classification is performed in the same manner as in Production Example 1 of the toner to obtain Toner Particles 10. Hydrophobic silica fine powder is externally added to Toner Particles 10 to obtain Toner 10.

Example 11

Production is performed in the same manner as in Example 1 except that the colorant C.I. Pigment Blue 15:3 used in Example 1 is replaced by 14.0 parts of quinacridone (C.I. Pigment Violet 19), and Polymer 1 is replaced by 0.500 parts of Polymer 7 obtained in Production Example 7. Thus, Toner 11 is obtained.

Example 20

Production of Polyester Resin 5

| | |
|---|---|
| Bisphenol A Propylene oxide 2.2 mol adduct | 1200.0 parts |
| Bisphenol A Ethylene oxide 2.2 mol adduct | 475.0 parts |

-continued

| | |
|---|---|
| Terephthalic acid | 250.0 parts |
| Trimellitic anhydride | 190.0 parts |
| Fumaric acid | 290.0 parts |
| Dibutyltin oxide | 0.1 parts |

These are placed in a 4 L four-necked glass flask. A thermometer, a stirring rod, a capacitor, and a nitrogen introducing pipe are attached to the flask. Then, the flask is placed within a mantle heater. A reaction is made under a nitrogen atmosphere at 220° C. for 5 hours to obtain Polyester Resin 5.

| | |
|---|---|
| Polyester Resin 5 | 89.5 parts |
| C.I. Pigment Blue 15:3 | 5.50 parts |
| Paraffin wax (HNP-7: made by NIPPON SEIRO CO., LTD.) | 5.00 parts |
| Polymer 1 in Production Example 1 | 0.500 parts |

The toner materials are sufficiently premixed by a Henschel mixer (made by Mitsui Miike Kakoki K.K.), melt kneaded by a twin screw extruder, and cooled. Then, using a hammer mill, the kneaded product is crushed into a particle size of approximately 1 to 2 mm. Next, the product is pulverized by an air jet pulverizer. Further, the obtained pulverized product is classified by a multi classifier to obtain Toner Particles 20. Further, hydrophobic silica fine powder is externally added to Toner Particles 20 in the same manner as in Production Example 1 of the toner to obtain Toner 20.

Example 21

Production is performed in the same manner as in Example 20 except that Polymer 1 used in Example 20 is replaced by 1.25 parts of Polymer 5 in Production Example 5. Thus, Toner 21 is obtained.

Comparative Examples 1 to 3

Production is performed in the same manner as in Example 1 except that the kind of the polymer used in Example 1 is changed as shown in Table 4. Thus, Toners 22 to 24 for Comparative Example are obtained.

Comparative Example 4

Production is performed in the same manner as in Example 1 except that Polymer 1 used in Example 1 is not used. Thus, Toner 25 for Comparative Example is obtained.

The physical properties of the toners obtained above are shown in Table 4.

TABLE 4

| | | Polymer | | Toner | | | | |
|---|---|---|---|---|---|---|---|---|
| | | | | | Molar ratio | | | |
| | Toner | Kind | Amount to be added (parts) | Content b of the structure B (μmol/g) | a/b of structure A to structure B a/b | Tg (° C.) | Average particle size D4 (μm) | Production method |
| Example 1 | Toner 1 | Polymer1 | 0.50 | 1.42 | 1.07 | 58.1 | 6.8 | Suspension polymerization |
| Example 2 | Toner 2 | Polymer1 | 1.00 | 2.85 | 1.07 | 58.0 | 6.7 | Suspension polymerization |
| Example 3 | Toner 3 | Polymer1 | 0.40 | 1.14 | 1.07 | 58.0 | 6.8 | Suspension polymerization |

TABLE 4-continued

| | | Polymer | | Toner | | | | |
|---|---|---|---|---|---|---|---|---|
| | | | | | Molar ratio | | | |
| | Toner | Kind | Amount to be added (parts) | Content b of the structure B (μmol/g) | a/b of structure A to structure B a/b | Tg (° C.) | Average particle size D4 (μm) | Production method |
| Example 4 | Toner 4 | Polymer1 | 0.10 | 0.28 | 1.07 | 58.1 | 6.9 | Suspension polymerization |
| Example 5 | Toner 5 | Polymer1 | 0.50 | 5.63 | 0.11 | 58.0 | 6.8 | Suspension polymerization |
| Example 6 | Toner 6 | Polymer3 | 0.50 | 5.62 | 0.05 | 58.3 | 6.7 | Suspension polymerization |
| Example 7 | Toner 7 | Polymer4 | 2.50 | 2.42 | 9.47 | 58.2 | 6.8 | Suspension polymerization |
| Example 8 | Toner 8 | Polymer5 | 2.50 | 1.08 | 21.09 | 58.0 | 6.7 | Suspension polymerization |
| Example 9 | Toner 9 | Polymer5 | 1.25 | 0.54 | 21.09 | 58.0 | 6.9 | Suspension polymerization |
| Example 10 | Toner 10 | Polymer6 | 0.50 | 1.72 | 2.66 | 57.9 | 6.8 | Suspension polymerization |
| Example 11 | Toner 11 | Polymer7 | 0.50 | 2.02 | 0.45 | 58.0 | 6.9 | Suspension polymerization |
| Example 12 | Toner 12 | Polymer8 | 0.50 | 1.83 | 1.67 | 58.1 | 6.8 | Suspension polymerization |
| Example 13 | Toner 13 | Polymer9 | 0.50 | 1.81 | 1.02 | 57.9 | 6.7 | Suspension polymerization |
| Example 14 | Toner 14 | Polymer10 | 0.50 | 1.17 | 1.56 | 58.0 | 6.8 | Suspension polymerization |
| Example 15 | Toner 15 | Polymer11 | 0.50 | 4.49 | 0.16 | 58.0 | 6.9 | Suspension polymerization |
| Example 16 | Toner 16 | Polymer12 | 0.50 | 4.61 | 0.08 | 57.9 | 6.8 | Suspension polymerization |
| Example 17 | Toner 17 | Polymer13 | 0.05 | 0.45 | 0.08 | 58.0 | 6.9 | Suspension polymerization |
| Example 18 | Toner 18 | Polymer14 | 0.50 | 1.36 | 1.10 | 58.1 | 6.7 | Suspension polymerization |
| Example 19 | Toner 19 | Polymer15 | 0.50 | 0.65 | 14.18 | 57.9 | 6.7 | Suspension polymerization |
| Example 20 | Toner 20 | Polymer1 | 0.50 | 1.47 | 1.07 | 58.0 | 6.8 | Crushing |
| Example 21 | Toner 21 | Polymer5 | 1.25 | 0.54 | 21.09 | 58.1 | 6.7 | Crushing |
| Comparative Example 1 | Toner 22 | Polymer16 | 0.50 | — | — | 58.2 | 6.8 | Suspension polymerization |
| Comparative Example 2 | Toner 23 | Polymer17 | 0.50 | — | — | 57.9 | 6.9 | Suspension polymerization |
| Comparative Example 3 | Toner 24 | Polymer18 | 0.50 | 1.42 | 0.00 | 58.0 | 6.8 | Suspension polymerization |
| Comparative Example 4 | Toner 25 | — | — | — | — | 58.1 | 6.8 | Suspension polymerization |

Here, each of Toners 1 to 25 according to Examples 1 to 21 and Comparative Examples 1 to 4 is mixed with a ferrite carrier F813-300 (made by Powdertech Co., Ltd.) such that the concentration of the toner is 5.0% by mass, to prepare a two-component developer.

The toner above and two-component developer are evaluated as follows.

1) Evaluation of Rise Property of Charging and Environmental Dependency:

50 g of the two-component developer is taken, and left for 4 days in a low temperature and low humidity environment (10° C./10% Rh). Another 50 g of the two-component developer is left for 4 days in a high temperature and high humidity environment (33° C./80% Rh). Then, the two-component developer is placed in a 50 cc plastic container, shaken 20 times over 10 seconds, and shaken 300 times over 2 minutes 30 seconds. The two-component developer is measured using the apparatus illustrated in FIG. 1. In 20 times of shaking and 300 times of shaking, the absolute value of the frictional charging amount is measured, and determined and evaluated according to the following criteria. The result is shown in Table 5.

<Rise Property in Charging>

The proportion of the absolute value of the frictional charging amount in 20 times of shaking to that after 300 times of shaking is calculated, and evaluated according to the following criteria:

A rank: not less than 90%

B rank: not less than 80% and less than 90%

C rank: not less than 70% and less than 80%

D rank: less than 70%

<Environmental Dependency>

The difference between the frictional charging amount after 300 times of shaking under a low temperature and low humidity and that after 300 times of shaking under a high temperature and high humidity is calculated, and evaluated according to the following criteria:

A rank: not less than 0 mC/kg and less than 15 mC/kg

B rank: not less than 15 mC/kg and less than 25 mC/kg

C rank: not less than 25 mC/kg and less than 35 mC/kg

D rank: not less than 35 mC/kg (Method for Measuring Charging Amount)

0.500 g of the two-component developer to be measured for the frictional charging amount is placed in a metallic measuring container 2 having a 500 mesh (opening of 25 μm) screen 3 in the bottom. Then, the measuring container 2 is covered with a metallic cover 4. The mass of the entire measuring container 2 at this time is a weight W1 (g). Next, in a suction apparatus 1 (a portion contacting the measuring container 2 is at least an insulating body), the toner is sucked from a suction port 7, and a wind amount control valve 6 is adjusted to provide a pressure of 250 mmAq in a vacuum gauge 5. In this state, the toner is sucked sufficiently and preferably for 2 minutes, and removed by sucking. The potential in the electrometer 9 at this time is V (volt). Here, a capacitor 8 is illustrated, and the capacitance is C (μF). The mass of the entire measuring container after suction is a weight W2 (g). The frictional charging amount (mC/kg) of the toner is calculated by the equation below.

$$\text{Frictional charging amount(mC/kg)}=(C\times V)/(W1-W2)$$

As a result, it turns out that the toners in Examples 1 to 21 according to the present invention have the rise property in charging and environmental dependency superior to those of the toners in Comparative Examples 1 to 4.

TABLE 5

| | Toner | Rise properties in charging (%) | | |
|---|---|---|---|---|
| | | Under low temperature and low humidity | Under high temperature and high humidity | Environmental dependency (mC/kg) |
| Example 1 | Toner 1 | 97 | 97 | 8 |
| Example 2 | Toner 2 | 96 | 97 | 8 |
| Example 3 | Toner 3 | 96 | 97 | 13 |
| Example 4 | Toner 4 | 92 | 92 | 17 |
| Example 5 | Toner 5 | 93 | 95 | 10 |
| Example 6 | Toner 6 | 88 | 93 | 14 |
| Example 7 | Toner 7 | 96 | 91 | 12 |
| Example 8 | Toner 8 | 92 | 92 | 18 |
| Example 9 | Toner 9 | 87 | 88 | 19 |
| Example 10 | Toner 10 | 97 | 97 | 8 |
| Example 11 | Toner 11 | 96 | 96 | 10 |
| Example 12 | Toner 12 | 97 | 97 | 9 |
| Example 13 | Toner 13 | 96 | 96 | 10 |
| Example 14 | Toner 14 | 95 | 96 | 13 |
| Example 15 | Toner 15 | 92 | 95 | 10 |
| Example 16 | Toner 16 | 87 | 90 | 14 |
| Example 17 | Toner 17 | 88 | 86 | 18 |
| Example 18 | Toner 18 | 87 | 86 | 17 |
| Example 19 | Toner 19 | 78 | 82 | 19 |
| Example 20 | Toner 20 | 86 | 87 | 20 |
| Example 21 | Toner 21 | 83 | 82 | 22 |
| Comparative Example 1 | Toner 22 | 71 | 71 | 34 |
| Comparative Example 2 | Toner 23 | 72 | 70 | 33 |
| Comparative Example 3 | Toner 24 | 68 | 72 | 28 |
| Comparative Example 4 | Toner 25 | 60 | 62 | 38 |

Next, the toners in Examples 1 to 21 and Comparative Examples 1 to 4 are evaluated for image output.

2) Evaluation of Image Output:

Using a modified machine of a full color printer LBP-5300 (made by Canon Inc.) (process speed: 220 mm/sec) as an evaluation machine, image output is evaluated at 23° C./60% Rh (under a normal temperature and normal humidity environment) and 33° C./80% Rh (under a high temperature and high humidity environment). 130 g of each of the toners is filled into a cartridge for image output, and the cartridge is mounted on a cyan station. In addition, a dummy cartridge is mounted. Then, an image under a normal temperature and normal humidity environment and that under a high temperature and high humidity environment are evaluated. In the evaluation of image output, the cartridge for image output is left under each of the environments for 4 days. After that, the evaluation is performed.

In the image output test, 1 to 5 sheets to be output is referred to as Initial Stage 1, 45 to 50 sheets to be output is referred to as Initial Stage 2, and 9995 to 10000 sheets to be output is referred to as After Durability Test. The density of the image and fogging are measured, and the average values thereof are determined. In this test, using an A4 normal paper of 75 g/m$^2$, an original chart having an image area rate of 2% is continuously output. The result is shown in Table 6.

(Density of Image)

In the measurement of the density of the image, using a Macbeth reflection densitometer RD918 (made by Gretag Macbeth GmbH), a relative density to a white portion in a printed image of an original having a density of 0.00 is measured, and evaluated according to the following criteria.

A rank: not less than 1.40

B rank: not less than 1.30 and less than 1.40

C rank: not less than 1.20 and less than 1.30

D rank: less than 1.20

(Measurement of Fogging)

Fogging is measured using a REFLECTOMETER MODEL TC-6DS (made by Tokyo Denshoku Co., Ltd.), and calculated by the equation below. A smaller numeric value shows more suppressed fogging.

$$\text{Fogging(reflectance)(\%)}=[\text{reflectance of standard paper(\%)}]-[\text{reflectance of non-image portion in sample(\%)}]$$

Evaluation is performed according to the following criteria.

A rank: not more than 0.5%

B rank: more than 0.5% and not more than 1.0%

C rank: more than 1.0% and not more than 1.5%

D rank: more than 1.5% and not more than 2.5%

E rank: more than 2.5%

TABLE 6

| | Toner | Under normal temperature and normal humidity | | | | | | Under a high temperature and high humidity | | | | | |
|---|---|---|---|---|---|---|---|---|---|---|---|---|---|
| | | Density of image | | | Fogging (%) | | | Density of image | | | Fogging (%) | | |
| | | Initial Stage 1 | Initial Stage 2 | After Durability Test | Initial Stage 1 | Initial Stage 2 | After Durability Test | Initial Stage 1 | Initial Stage 2 | After Durability Test | Initial Stage 1 | Initial Stage 2 | After Durability Test |
| Example 1 | Toner 1 | 1.49 | 1.50 | 1.49 | 0.2 | 0.1 | 0.2 | 1.48 | 1.5 | 1.48 | 0.3 | 0.2 | 0.2 |
| Example 2 | Toner 2 | 1.49 | 1.50 | 1.50 | 0.2 | 0.1 | 0.1 | 1.48 | 1.49 | 1.49 | 0.2 | 0.2 | 0.2 |

TABLE 6-continued

| | | Under normal temperature and normal humidity | | | | | | Under a high temperature and high humidity | | | | | |
|---|---|---|---|---|---|---|---|---|---|---|---|---|---|
| | | Density of image | | | Fogging (%) | | | Density of image | | | Fogging (%) | | |
| | Toner | Initial Stage 1 | Initial Stage 2 | After Durability Test | Initial Stage 1 | Initial Stage 2 | After Durability Test | Initial Stage 1 | Initial Stage 2 | After Durability Test | Initial Stage 1 | Initial Stage 2 | After Durability Test |
| Example 3 | Toner 3 | 1.47 | 1.48 | 1.47 | 0.3 | 0.2 | 0.2 | 1.43 | 1.48 | 1.47 | 0.4 | 0.3 | 0.2 |
| Example 4 | Toner 4 | 1.40 | 1.46 | 1.47 | 0.4 | 0.3 | 0.3 | 1.34 | 1.39 | 1.42 | 0.7 | 0.4 | 0.5 |
| Example 5 | Toner 5 | 1.42 | 1.48 | 1.48 | 0.4 | 0.2 | 0.3 | 1.45 | 1.46 | 1.46 | 0.3 | 0.3 | 0.3 |
| Example 6 | Toner 6 | 1.37 | 1.46 | 1.45 | 0.5 | 0.3 | 0.3 | 1.36 | 1.41 | 1.45 | 0.7 | 0.3 | 0.5 |
| Example 7 | Toner 7 | 1.47 | 1.48 | 1.47 | 0.3 | 0.2 | 0.3 | 1.41 | 1.43 | 1.45 | 0.4 | 0.3 | 0.3 |
| Example 8 | Toner 8 | 1.41 | 1.46 | 1.45 | 0.5 | 0.3 | 0.3 | 1.33 | 1.37 | 1.41 | 0.7 | 0.5 | 0.5 |
| Example 9 | Toner 9 | 1.37 | 1.42 | 1.41 | 0.8 | 0.4 | 0.5 | 1.32 | 1.36 | 1.40 | 0.8 | 0.7 | 0.8 |
| Example 10 | Toner 10 | 1.48 | 1.49 | 1.48 | 0.2 | 0.2 | 0.2 | 1.48 | 1.48 | 1.47 | 0.3 | 0.2 | 0.3 |
| Example 11 | Toner 11 | 1.48 | 1.49 | 1.48 | 0.3 | 0.2 | 0.2 | 1.47 | 1.48 | 1.47 | 0.3 | 0.3 | 0.3 |
| Example 12 | Toner 12 | 1.49 | 1.5 | 1.49 | 0.2 | 0.1 | 0.2 | 1.48 | 1.49 | 1.48 | 0.3 | 0.2 | 0.3 |
| Example 13 | Toner 13 | 1.47 | 1.50 | 1.49 | 0.3 | 0.2 | 0.3 | 1.45 | 1.47 | 1.46 | 0.3 | 0.3 | 0.3 |
| Example 14 | Toner 14 | 1.47 | 1.5 | 1.49 | 0.3 | 0.2 | 0.3 | 1.42 | 1.46 | 1.45 | 0.5 | 0.3 | 0.3 |
| Example 15 | Toner 15 | 1.41 | 1.47 | 1.46 | 0.4 | 0.2 | 0.3 | 1.45 | 1.47 | 1.46 | 0.3 | 0.3 | 0.3 |
| Example 16 | Toner 16 | 1.38 | 1.45 | 1.45 | 0.5 | 0.3 | 0.3 | 1.36 | 1.40 | 1.45 | 0.6 | 0.3 | 0.5 |
| Example 17 | Toner 17 | 1.36 | 1.42 | 1.41 | 0.7 | 0.4 | 0.5 | 1.32 | 1.37 | 1.41 | 0.7 | 0.6 | 0.7 |
| Example 18 | Toner 18 | 1.35 | 1.41 | 1.40 | 0.7 | 0.5 | 0.5 | 1.36 | 1.39 | 1.37 | 0.7 | 0.7 | 0.8 |
| Example 19 | Toner 19 | 1.33 | 1.38 | 1.34 | 0.8 | 0.6 | 0.7 | 1.28 | 1.36 | 1.32 | 1.3 | 0.7 | 0.8 |
| Example 20 | Toner 20 | 1.37 | 1.42 | 1.41 | 0.7 | 0.5 | 0.8 | 1.31 | 1.39 | 1.37 | 0.8 | 0.7 | 1.0 |
| Example 21 | Toner 21 | 1.33 | 1.37 | 1.34 | 0.8 | 0.5 | 0.8 | 1.31 | 1.35 | 1.32 | 0.9 | 0.7 | 1.3 |
| Comparative Example 1 | Toner 22 | 1.22 | 1.28 | 1.23 | 2.2 | 1.3 | 1.5 | 1.14 | 1.21 | 1.19 | 2.3 | 1.5 | 1.9 |
| Comparative Example 2 | Toner 23 | 1.23 | 1.27 | 1.24 | 2.0 | 1.2 | 1.4 | 1.17 | 1.22 | 1.18 | 2.0 | 1.4 | 1.7 |
| Comparative Example 3 | Toner 24 | 1.25 | 1.34 | 1.32 | 1.6 | 1.2 | 1.6 | 1.21 | 1.32 | 1.30 | 1.7 | 1.4 | 1.8 |
| Comparative Example 4 | Toner 25 | 1.10 | 1.19 | 1.12 | 3.0 | 2.6 | 3.5 | 1.03 | 1.08 | 1.05 | 3.5 | 2.8 | 4.0 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-111617, filed May 18, 2011, which is hereby incorporated by reference herein in its entirety.

REFERENCE SIGNS LIST

1 suction apparatus, 2 measuring container, 3 screen, 4 cover, 5 vacuum gauge, 6 wind amount control valve, 7 suction port, 8 capacitor, 9 electrometer

The invention claimed is:

1. A toner comprising toner particles, each of which contains a binder resin, a colorant, and a charge controlling resin, wherein the charge controlling resin is a polymer having a structure A represented by a formula (1) and a structure B represented by a formula (2):

Formula (1)

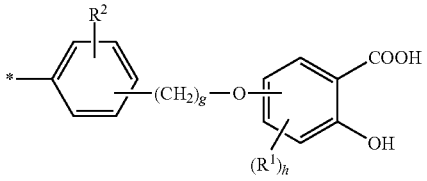

-continued

Formula (2)

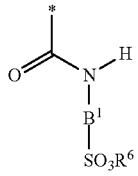

wherein in the formula (1), $R^1$ represents a hydroxyl group, a carboxyl group, an alkyl group having not less than 1 and not more than 18 carbon atoms, or an alkoxyl group having not less than 1 and not more than 18 carbon atoms;

$R^2$ represents a hydrogen atom, a hydroxyl group, an alkyl group having not less than 1 and not more than 18 carbon atoms, or an alkoxyl group having not less than 1 and not more than 18 carbon atoms;

g represents an integer of not less than 1 and not more than 3; h represents an integer of not less than 0 and not more than 3; if h is 2 or 3, $R^1$ is each independently selected;

in the formula (2), $R^6$ represents a hydrogen atom or an alkyl group having not less than 1 and not more than 12 carbon atoms;

$B^1$ represents an alkylene structure that has 1 or 2 carbon atoms and may have a substituent, or an aromatic ring that may have a substituent; the substituent in the alkylene structure is a hydroxyl group, an alkyl group having not less than 1 and not more than 12 carbon atoms, an aryl group having 6 or 12 carbon atoms, or an alkoxyl group having not less than 1 and not more than 12 carbon atoms; the substituent in the aromatic ring is a hydroxyl group, an alkyl group having not less than 1 and not more than 12 carbon atoms, or an alkoxyl group having not less than 1 and not more than 12 carbon atoms; and

* sites in the structure A and the structure B are coupling sites in the polymer.

2. The toner according to claim 1, wherein the structure A is contained in the polymer as a partial structure represented by a formula (3), and the structure B is contained in the polymer as a partial structure represented by a formula (4):

Formula (3)

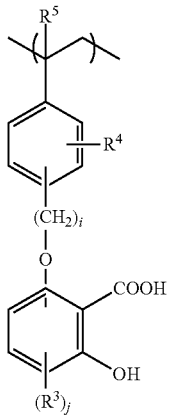

wherein $R^3$ represents a hydroxyl group, a carboxyl group, an alkyl group having not less than 1 and not more than 18 carbon atoms, or an alkoxyl group having not less than 1 and not more than 18 carbon atoms;

$R^4$ represents a hydrogen atom, a hydroxyl group, an alkyl group having not less than 1 and not more than 18 carbon atoms, or an alkoxyl group having not less than 1 and not more than 18 carbon atoms;

$R^5$ represents a hydrogen atom or a methyl group;

i represents an integer of not less than 1 and not more than 3; j represents an integer of not less than 0 and not more than 3; if j is 2 or 3, $R^3$ is each independently selected;

Formula (4)

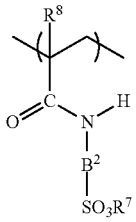

wherein $R^7$ represents a hydrogen atom or an alkyl group having not less than 1 and not more than 12 carbon atoms;

$R^8$ represents a hydrogen atom or a methyl group;

$B^2$ is an alkylene structure that has 1 or 2 carbon atoms and may have a substituent, or an aromatic ring that may have a substituent; the substituent in the alkylene structure is a hydroxyl group, an alkyl group having not less than 1 and not more than 12 carbon atoms, an aryl group having 6 or 12 carbon atoms, or an alkoxyl group having not less than 1 and not more than 12 carbon atoms; the substituent in the aromatic ring is a hydroxyl group, an alkyl group having not less than 1 and not more than 12 carbon atoms, or an alkoxyl group having not less than 1 and not more than 12 carbon atoms.

3. The toner according to claim 1, when the content of the structure A represented by the formula (1) in the toner is a (μmol/g), and the content of the structure B represented by the formula (2) in the toner is b (μmol/g), the ratio a/b is $0.10 \leq a/b \leq 10.0$, and a content b is not less than 0.100 μmol/g.

4. The toner according to claim 1, wherein the toner particles are toner particles obtained by adding a polymerizable monomer composition containing a polymerizable monomer and the charge controlling resin to an aqueous medium, granulating the polymerizable monomer composition in the aqueous medium to form particles of the polymerizable monomer composition, and polymerizing the polymerizable monomer contained in the particles.

* * * * *